US010076915B2

(12) United States Patent
LaCaze

(10) Patent No.: US 10,076,915 B2
(45) Date of Patent: Sep. 18, 2018

(54) CONTINUOUS MOTION PRINTING ON CYLINDRICAL OBJECTS

(71) Applicant: INX INTERNATIONAL INK COMPANY, Owens Cross Roads, AL (US)

(72) Inventor: John Randel LaCaze, Hampton Cove, AL (US)

(73) Assignee: INX INTERNATIONAL INK COMPANY, Owens Cross Roads, AL (US)

( * ) Notice: Subject to any disclaimer, the term of this patent is extended or adjusted under 35 U.S.C. 154(b) by 0 days.

(21) Appl. No.: 15/376,317

(22) Filed: Dec. 12, 2016

(65) Prior Publication Data

US 2017/0182791 A1 Jun. 29, 2017

Related U.S. Application Data

(63) Continuation of application No. 14/608,176, filed on Jan. 28, 2015, now Pat. No. 9,517,623.

(60) Provisional application No. 61/932,522, filed on Jan. 28, 2014.

(51) Int. Cl.

| | |
|---|---|
| ***B41J 2/21*** | (2006.01) |
| ***B41J 3/407*** | (2006.01) |
| ***B41J 25/00*** | (2006.01) |
| ***B41J 3/00*** | (2006.01) |

(52) U.S. Cl.

CPC ..... *B41J 2/2132* (2013.01); *B41J 3/00* (2013.01); *B41J 3/4073* (2013.01); *B41J 25/00* (2013.01)

(58) Field of Classification Search

CPC ..... B41J 3/4073; B41J 29/38; B41J 23/00; B41F 17/08; B41F 17/18

See application file for complete search history.

(56) References Cited

U.S. PATENT DOCUMENTS

| | | | | |
|---|---|---|---|---|
| 6,637,860 | B1 | 10/2003 | Madeley | |
| 2004/0252174 | A1 * | 12/2004 | Baxter | B41J 3/4073 347/101 |
| 2010/0165043 | A1 | 7/2010 | McCoy et al. | |
| 2010/0295885 | A1 * | 11/2010 | LaCaze | B41J 3/4073 347/8 |

FOREIGN PATENT DOCUMENTS

| | | | | |
|---|---|---|---|---|
| EP | 2465678 | | 6/2012 | |
| EP | 2465678 | A1 * | 6/2012 | B41C 1/003 |
| GB | 2538289 | A * | 11/2016 | B29C 64/112 |

OTHER PUBLICATIONS

Extended European Search Report for Application No. 15167845 dated Jul. 1, 2016 (7 pages).

* cited by examiner

*Primary Examiner* — Geoffrey Mruk
*Assistant Examiner* — Scott A Richmond
(74) *Attorney, Agent, or Firm* — Michael Best & Friedrich LLP

(57) ABSTRACT

A method for printing a digitally-stored image on the surface of a cylindrical object comprises the steps of axially moving the object along a line of travel that is aligned with the object's long axis until it is underneath one or more printheads, each of which have a plurality of ink nozzles that may be arranged in one or more columns while simultaneously rotating the object with respect to the printheads and simultaneously causing a pre-determined number of nozzles to eject ink onto the surface of the object.

18 Claims, 25 Drawing Sheets

| | | | | |
|---|---|---|---|---|
| 2a:1:0 | | | | |
| | 2a:0:0 | | | |
| 2a:1:1 | | 2a:1:0,2b:1:1 | | |
| | 2a:0:1 | | 2a:0:0,2b:0:1 | |
| 2a:1:2 | | 2a:1:1,2b:1:2 | | 2a:1:0,2b:1:1,2c:1:2 |
| | 2a:0:2 | | 2a:0:1,2b:0:2 | |
| 2a:1:3 | | 2a:1:2,2b:1:3 | | 2a:1:1,2b:1:2,2c:1:3 |
| | 2a:0:3 | | 2a:0:2,2b:0:3 | |

| | | | | |
|---|---|---|---|---|
| | | | 2a:0:0,2b:0:1,2c:0:2 | |
| | | 2a:1:0,2b:1:1,2c:1:2,2d:1:3 | | |
| | 2a:0:1,2b:0:2,2c:0:3 | | | |
| 2a:0:0,2b:0:1,2c:0:2,2d:0:3 | | | | |

FIG. 8D

*SEQUENCE* 8

CONTINUOUS MOTION PRINTING ON CYLINDRICAL OBJECTS

BACKGROUND

Field

The present invention relates generally to printing, and particularly, to printing on cylindrical objects, such as cans, and substantially cylindrical objects, such as bottles via simultaneous axial and circumferential nozzle deposition interlacing in such a manner as to increase print resolution and commercial printing speeds.

Description of the Problem and Related Art

Current methods of printing indicia on cylindrical objects, such as cans or bottles, via digital printing with commercial inkjet printheads is known in the art. While these methods employ systems traditionally designed for flat surface printing, the adaptation to cylindrical printing imposes efficiency issues affecting print speed and quality, especially for multi-color applications. Printhead efficiency being largely a result of maximum printhead firing uptime, is compromised when printing cylindrical or substantially cylindrical objects with color over color printing, as is well known in the art.

Ink jet printing is well-known, and because it can be digitally controlled using a computer, it has the flexibility to allow a user to change designs as desired. Only recently, however, have advances in technology been made to enable true image rendering on non-planar objects. For example, U.S. Pat. No. 7,111,915 entitled, Methods and Apparatus for Image Transfer, issued Sep. 26, 2006, to Martinez, and LaCaze (the inventor herein), and which is incorporated herein fully by reference, describes an ink jet printer for the printing of indicia on non-planar objects such as baseball bats. Multiple bats are held in a horizontal carousel structure and are positioned relative to one to four printheads, each of which is dedicated to one of four colors: cyan, magenta, yellow and black. Each bat is then rotated in relation to a printhead which is computer-controlled to apply ink according to a programmed image file. However, because the printheads by necessity are arranged in series, the time required to complete a multi-color inkjet application increases with the addition of more colors, even though continuous, helical-type printing may be employed individually for each color.

Another example of printheads serially aligned is found in U.S. Pat. No. 8,931,864, entitled, Apparatuses for Printing on Generally Cylindrical Objects and Related Methods, issued Jan. 15, 2015, to LaCaze and which is incorporated fully by reference, describes an inkjet printer for the printing of indicia on generally cylindrical objects. A plurality of stationary digital printheads are arrayed in an arch oriented perpendicularly to a linear path along which the object to be printed is conveyed. An object, such as a can or bottle, is positioned relative to the arch and rotated about the objects long axis as the printheads eject ink. However, the object is incrementally advanced along the linear path i.e., indexed without the printheads jetting ink, which detracts from printhead firing efficiency and overall print speed.

To illustrate the problem, FIG. 1 depicts, an object to be printed 1 in relation to four printheads 2*a*-2*d* arrayed in an arch traversing the line of travel for the object which corresponds to the object's long axis. The object 1 is shown outside the start of the nozzle array which marks a plane intersecting the object's line of travel that once breached by the object, nozzles begin depositing ink upon the object's 1 surface. The object is indexed along the line of travel, i.e., axially, and rotated.

FIG. 2 depicts the apparatus from the side where the object 1 has advanced a sufficient distance, such that the object leading end (or the beginning of the intended print area of the object 1) is in line with the end of the nozzle array. As is shown here, it is possible—and in practice usually the case—that the length of the object to be printed 1 exceeds the available print length afforded by the digital printhead(s) 2*a*-2*d* in question.

FIG. 2*a* shows the object to be printed 1 linearly advanced further by a distance equal to the available print length afforded by the digital printhead(s) 2*a*-2*d*. The object 1 will continue to advance in steps equal to this same distance until the entire length of the object 1 is printed. Typically, this is repeated as many times as required to attain the desired print resolution, the number of passes depending upon the native resolution of the printheads 2*a*-2*d*. There are several problems maximizing the speed and resolution utilizing this state-of-the-art technology. Minimization of the time required to print the object 1 requires, among other criteria, the most efficient use of the printheads 2*a*-2*d*. This occurs when the printhead 2*a*-2*d* nozzles are firing (versus idle), that is, depositing ink, toner, etc. to the object 1 as is well known in the current art. The time necessary to print the object 1 increases as the printhead 2*a*-2*d* nozzle idle time increases. This occurs for each of the printheads 2*a*-2*d* when the object to be printed 1 is advancing to arrive at the next printing position, as the printheads 2*a*-2*d* do not fire during this movement. Additionally, print quality may suffer because axially indexing of the object 1 to be printed can result in print stitch lines that appear as lines demarking the boundaries between adjacent printed areas. Stitch lines are usually dealt with by blending adjacent printed areas together along the stitch line, but may still be observable and unappealing depending upon the accuracy and repeatability of object 1 positioning.

Another opportunity for printhead idle time with this arrangement is illustrated in FIG. 3. In the practical application of this technology, it is often desirable, and even necessary, to print the desired pattern on the object 1 by applying colors each other in a specific sequence, for example, applying yellow, cyan, magenta and black, specifically in that order. This example illustrates one of the common dictates of process printing, namely printing from "light" to "dark" colors in progression. In FIG. 3 the first digital printhead 2*a* would therefore print yellow, the second digital printhead 2*b* cyan, the third digital printhead 2*c* magenta, and the fourth digital printhead 2*d* black. Given when printing, the object 1 is rotating, but axially stationary, printhead 2*a* fires its nozzles first; printhead 2*b* only fires its nozzles as the print area of the object surface begins to pass beneath it; 2*c* fires as the print area f begins to pass beneath it, and so on.

Because of the lag between 2*a* and 2*d*, the object 1 must complete more than one rotation to complete the desired print while at the same time the object 1 must be axially advanced to account for the difference between its length and the length of the available print area, again resulting in decreased efficiency. Further, there is a period when all printheads 2*a*-2*d* are firing, but at the end of print, the process is reversed: the first printhead 2*a* stops firing while all other printheads 2*b*-2*d* are still firing; the second printhead 2*b* stops while the third printhead 2*c* and the fourth printhead 2*d* are still firing; and the third printhead 2*c* stops while the fourth printhead 2*d* is still firing. This cumulative lag time at the beginning and ending of the printing indexes has a deleterious effect upon the time it takes to print the object 1. Increasing the desired print resolution to be greater than the native printhead 2*a*-2*d* resolution only serves to exacerbate this problem by requiring additional print deposition(s) and indexes.

U.S. Pat. No. 8,926,047 entitled, Apparatuses for Printing on Generally Cylindrical Objects and Related Methods, issued Jan. 6, 2015, by LaCaze et al. (the inventor herein) incorporated herein fully by reference, addresses printhead inefficiency during simultaneous axial and rotational motion by offsetting the printheads in an axial direction relative to the long axis of the object to be printed. However, this creates a problem in that the degree of offset must be different object diameters as well as different print patterns and resolutions, potentially resulting in significant lost production time.

BRIEF DESCRIPTION OF THE DRAWINGS

The present invention is described with reference to the accompanying drawings. In the drawings, like reference numbers indicate identical or functionally similar elements.

FIG. 8D is a composite of the deposition pattern of all four printheads;

DETAILED DESCRIPTION

The various embodiments of the present invention and their advantages are best understood by referring to FIGS. 1 through 8E of the drawings. The elements of the drawings are not necessarily to scale, emphasis instead being placed upon clearly illustrating the principles of the invention. Throughout the drawings, like numerals are used for like and corresponding parts of the various drawings.

This invention may be provided in other specific forms and embodiments without departing from the essential characteristics as described herein. The embodiments described above are to be considered in all aspects as illustrative only and not restrictive in any manner. The following claims rather than the foregoing description indicate the scope of the invention.

Figure 1:
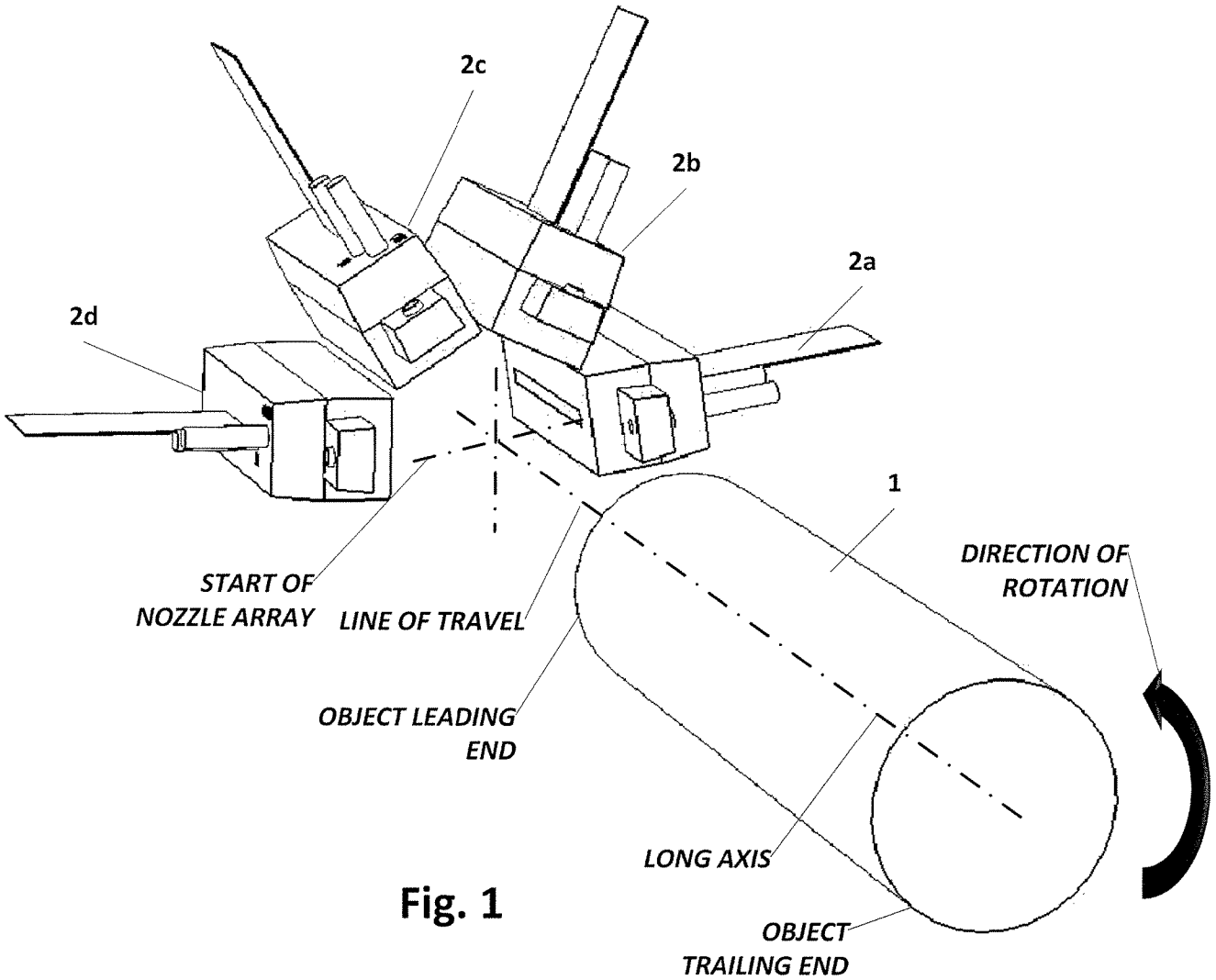
FIG. 1 is a perspective view of an exemplary printing system.
Figure 2:
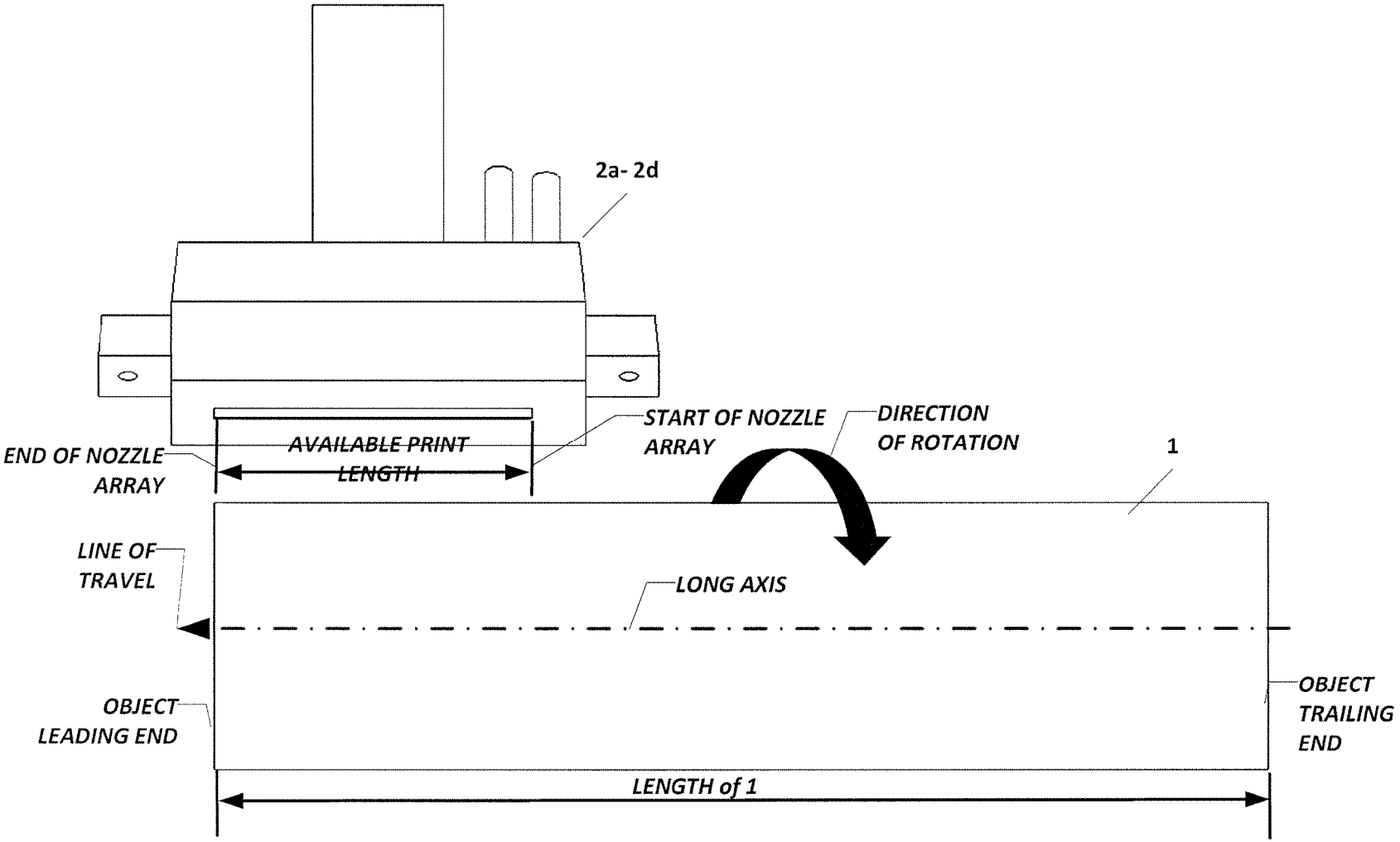
FIG. 2 is a side elevation of the exemplary printing system of FIG. 1.
Figure 2A:
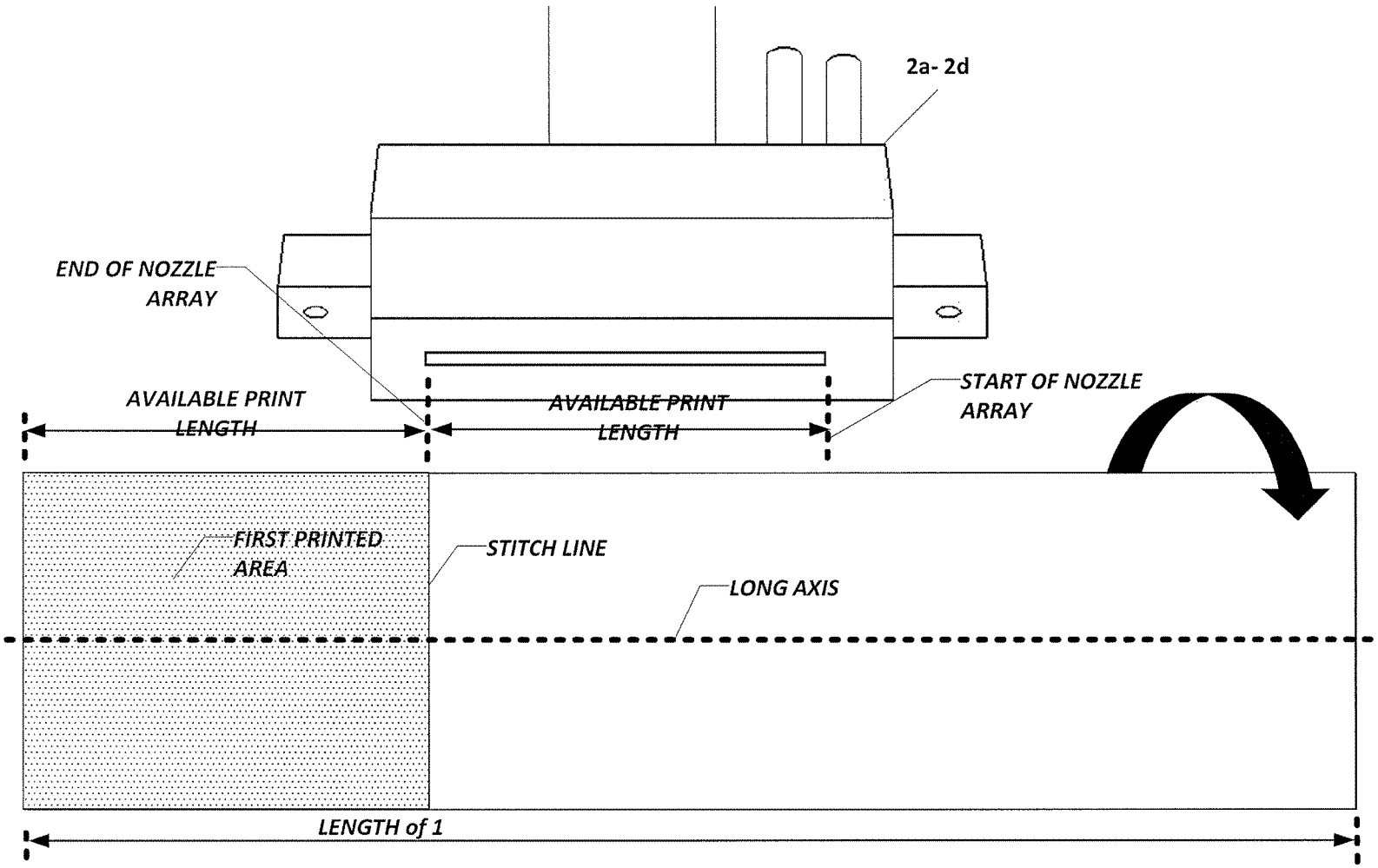
FIG. 2*a* is a side elevation of the system of FIG. 1 showing the object to be printed axially advanced.
Figure 3:
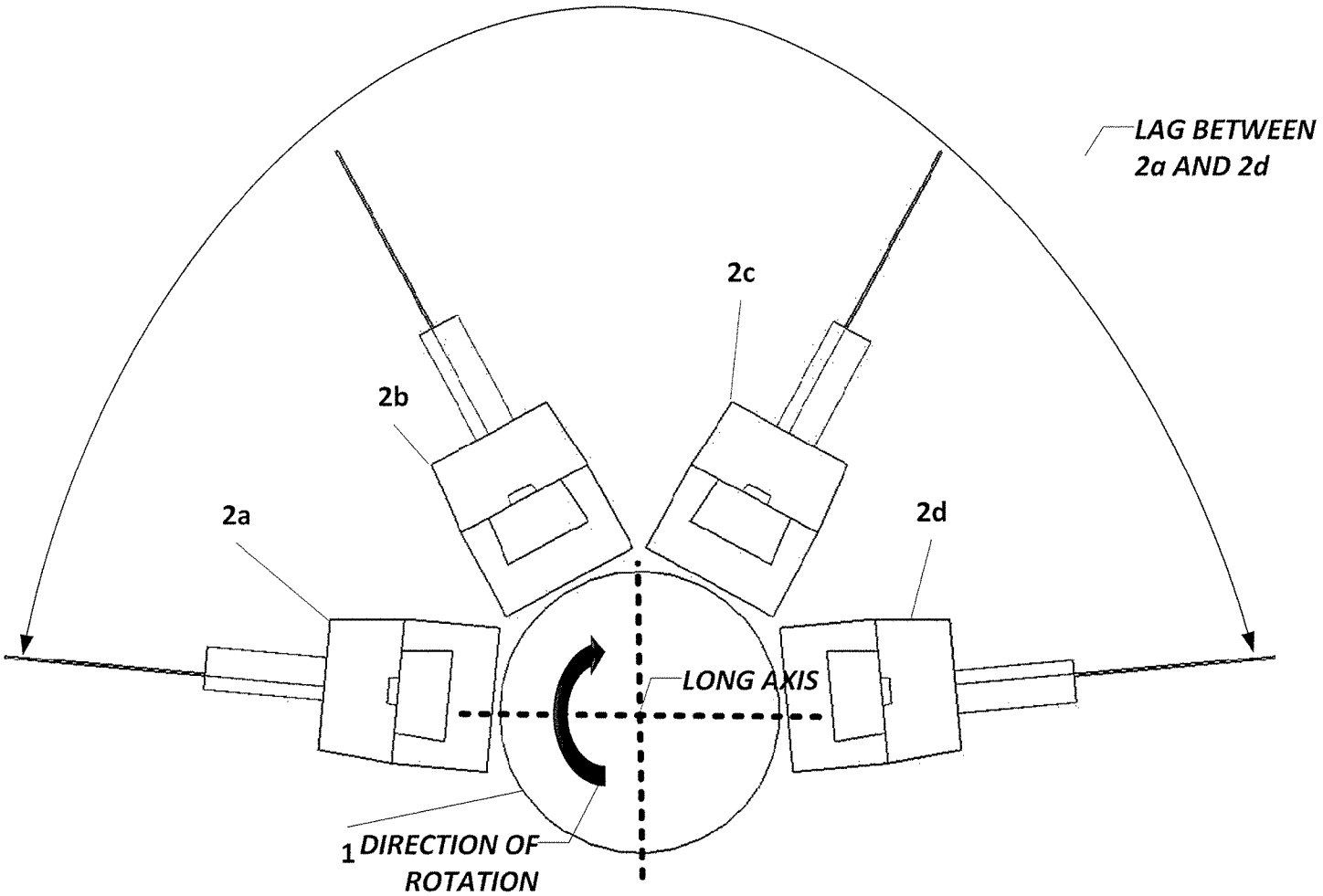
FIG. 3 is an end elevation view of the system of FIG. 1.
Figure 4:
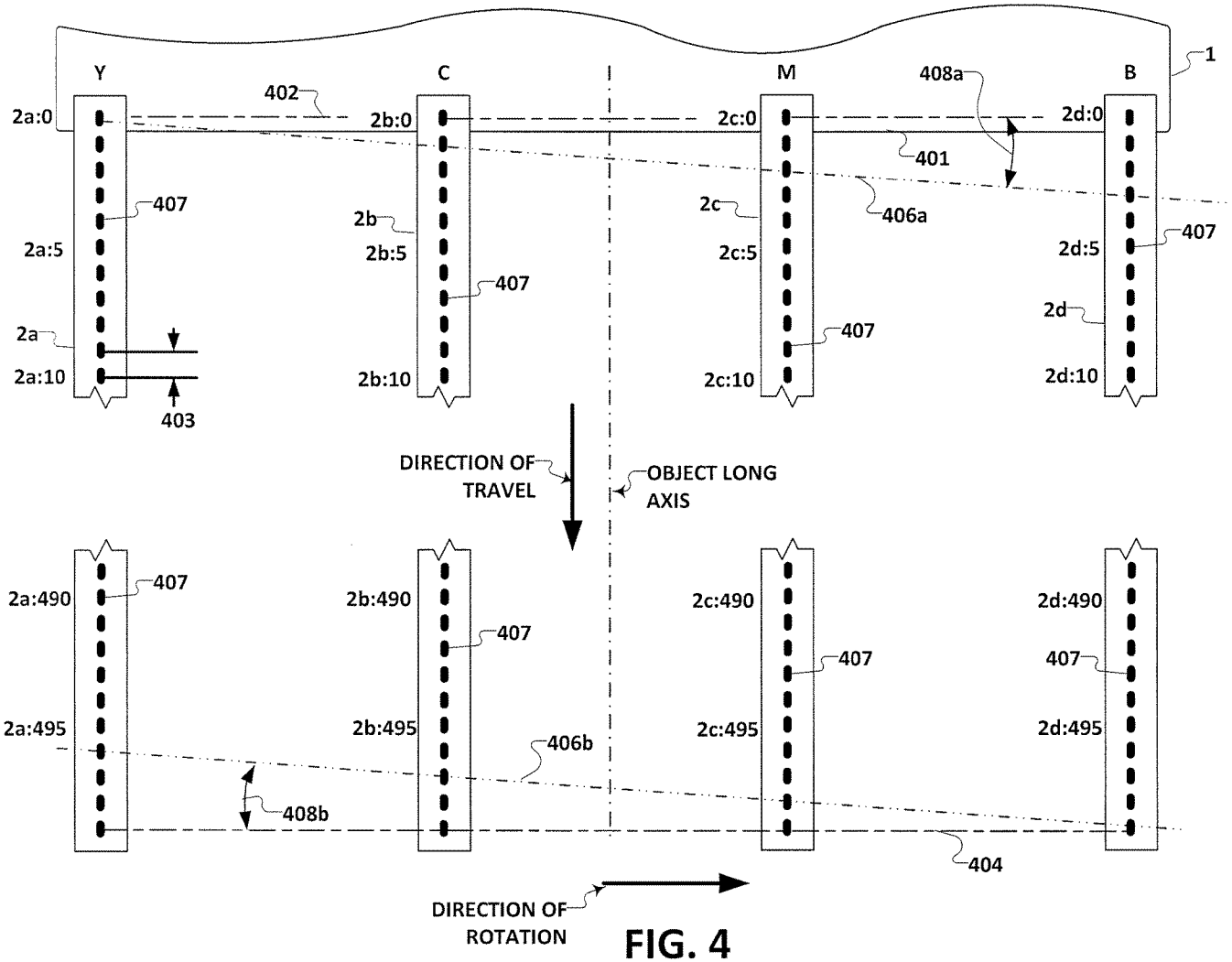
FIG. 4 illustrates an exemplary printhead configuration.

FIG. 4 represents an exemplary configuration of nozzles 407 for each printhead 2*a*-2*d*. In this example, each printhead 2*a*-2*d* comprises five hundred nozzles 407 in rows designated 0 through 499 and arrayed in a single column. Throughout, individual nozzles 407 may be referred to by their position reference. For example, the sixth nozzle 407 in printhead 2*c* is referred to as 2*c*:5.

The line defined by 2*a*:0 through 2*d*:0 is the start of the nozzle array 402 relative to the advancing object 1. Likewise, the line defined by nozzles 2*a*:499, 2*b*:499, 2*c*:499 and 2*d*:499 mark the end of the nozzle array 404. The printhead native resolution 403 is the space between nozzles 407.

As described above, colors are deposited on the object surface in order from light colors to dark colors, or from yellow (printhead 2*a*) to black (printhead 2*d*). Thus, corresponding nozzles, e.g., 2*a*:7, 2*b*:7, 2*c*:7 and 2*d*:7 eject ink in that order as the object 1 rotates beneath them. Were the object not advancing along the line of travel, all the nozzles 407 would fire. However, because the object 1 is axially advancing simultaneously with its rotational motion, the resulting deposition pattern is helical about the surface of the object 1 and not every nozzle 407 will be fired. Accordingly, it will be appreciated that in this example, certain nozzles 407 are not used as the object 1 advances and rotates. The number of unused nozzles 407 in each printhead 2*a*-2*d* is identical, but their location within each printhead 2 differs. In this example, that number is three per printhead 2*a*-2*d*, but the actual number in practice is dependent upon the desired print resolution, printhead 2*a*-2*d* native resolution 403, and firing frequency, as well as the axial and rotary motion speeds of the object 1 beneath the printheads 2*a*-2*d*, as will be appreciated by those skilled in the relevant arts.

To illustrate this, FIG. 4 shows that as the object 1 leading end 401 traverses the start of the nozzle array 402, nozzle 2*a*:0 fires first. The unused nozzles 2*a*:497-2*a*:499 of the first printhead 2*a* in this example total three and are located near the end of nozzle array 404. The second printhead 2*b* contains one unusable nozzle 2*b*:0 at the start of the nozzle array 402 and two unusable nozzles 2*b*:498-2*b*:499 at the end of array 404. The third printhead 2*c* contains two unusable nozzles 2*c*:0-2*c*:1 at the start of the nozzle array 402 and one unusable nozzle 2*c*:499 and the end of the array 404. The fourth printhead 2*d* contains three unusable nozzles 2*d*:0-2*d*:2 at the start of the nozzle array 402.

After first nozzle 2a:0 of the first printhead 2a deposits its ink, the result of which is a "dot" on the surface of the object 1, it will be printed over by the second nozzle 2b:1 of the second printhead 2b, the third nozzle 2c:2 of the third printhead 2c and the fourth nozzle 2d:3 of the fourth printhead 2d all of which lay along angled line 406a. In fact, it may be generalized in this example that 2a:*x* will be printed over by 2b:*x*+1, 2c:*x*+2 and 2d:*x*+3. The nature of printing, and specifically that of process printing, may result in not all positions on the object 1 surface receiving all colors. Alternatively, dots may not be overlaid exactly on one another and a dot may be offset from its predecessor. It can be seen the nozzles 407 that lie within the angle 408a defined between the angled line 406a and the start of the nozzle array 402 are not fired in this scheme.

Figure 4A:
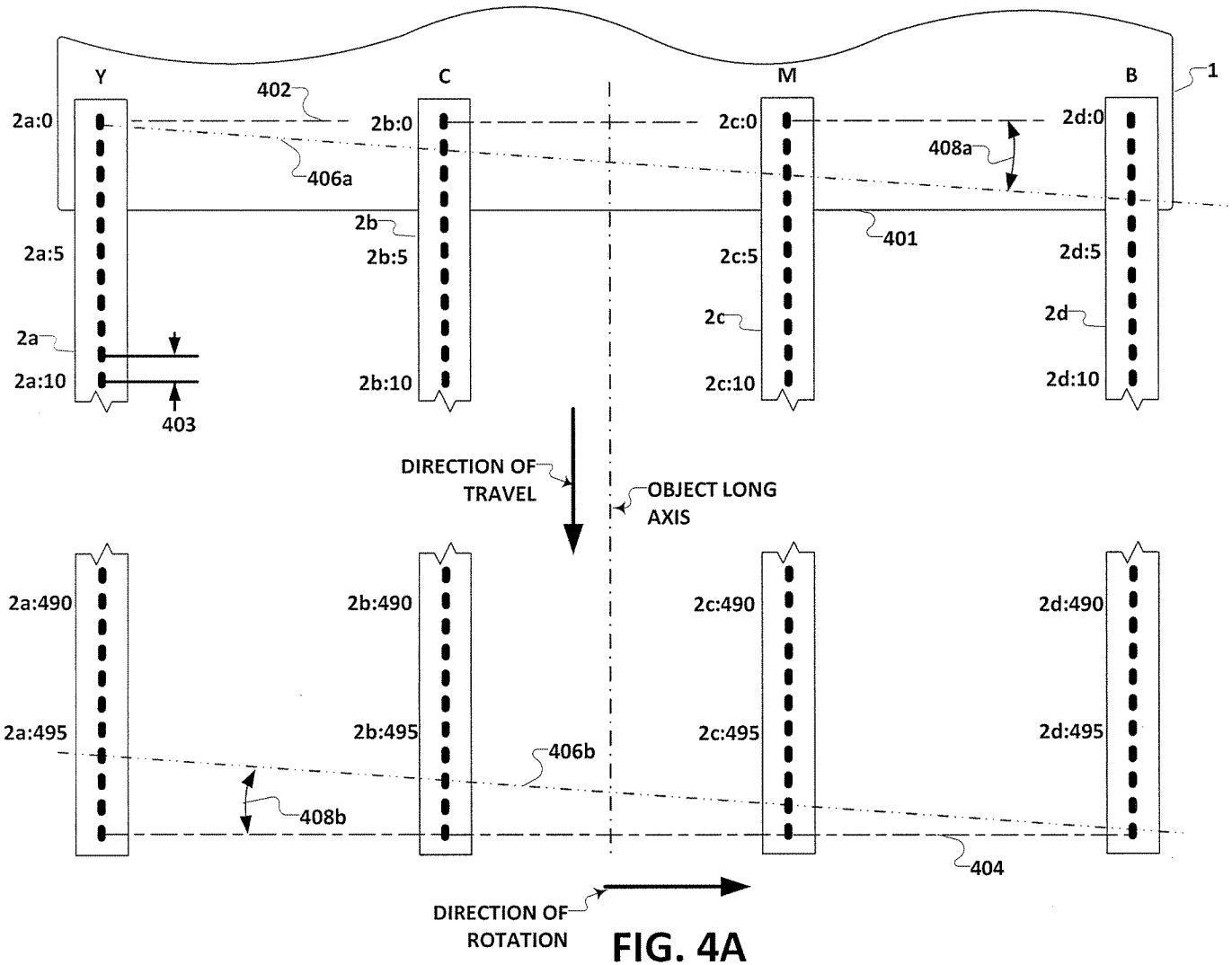
FIG. 4A is a view of the configuration of FIG. 4 showing the object to be printed advanced axially.

FIG. 4A depicts the object 1 continuing to pass beneath printheads 2a-2d, and axially advanced so that the leading end 401 is just beyond the angled line 406a. At this point, each corresponding nozzle 407 of printheads 2a-2d may be fired.

Figure 4B:
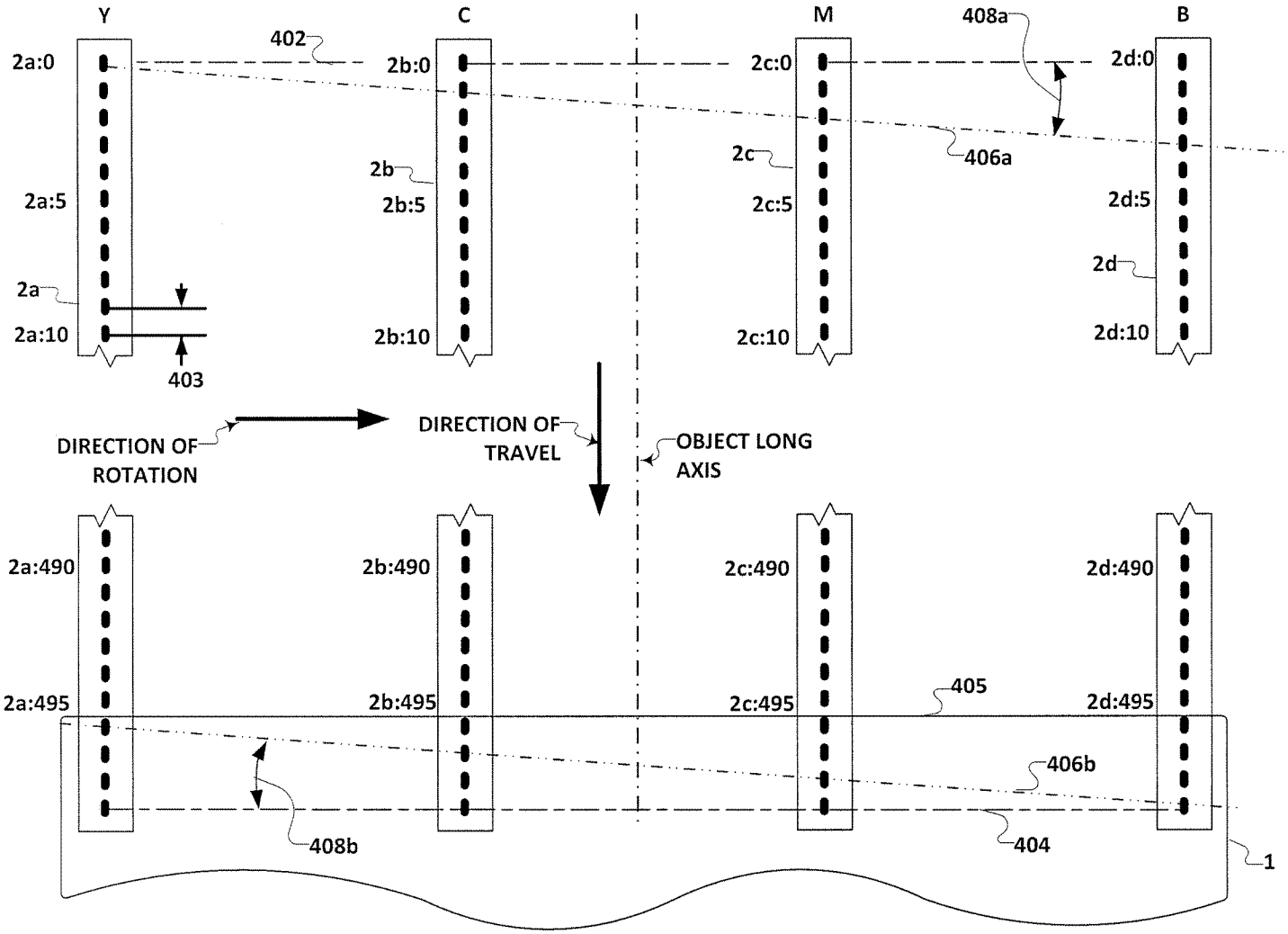
FIG. 4B is a view of the configuration of FIG. 4 showing the object to be printed advanced farther axially.
Figure 4C:
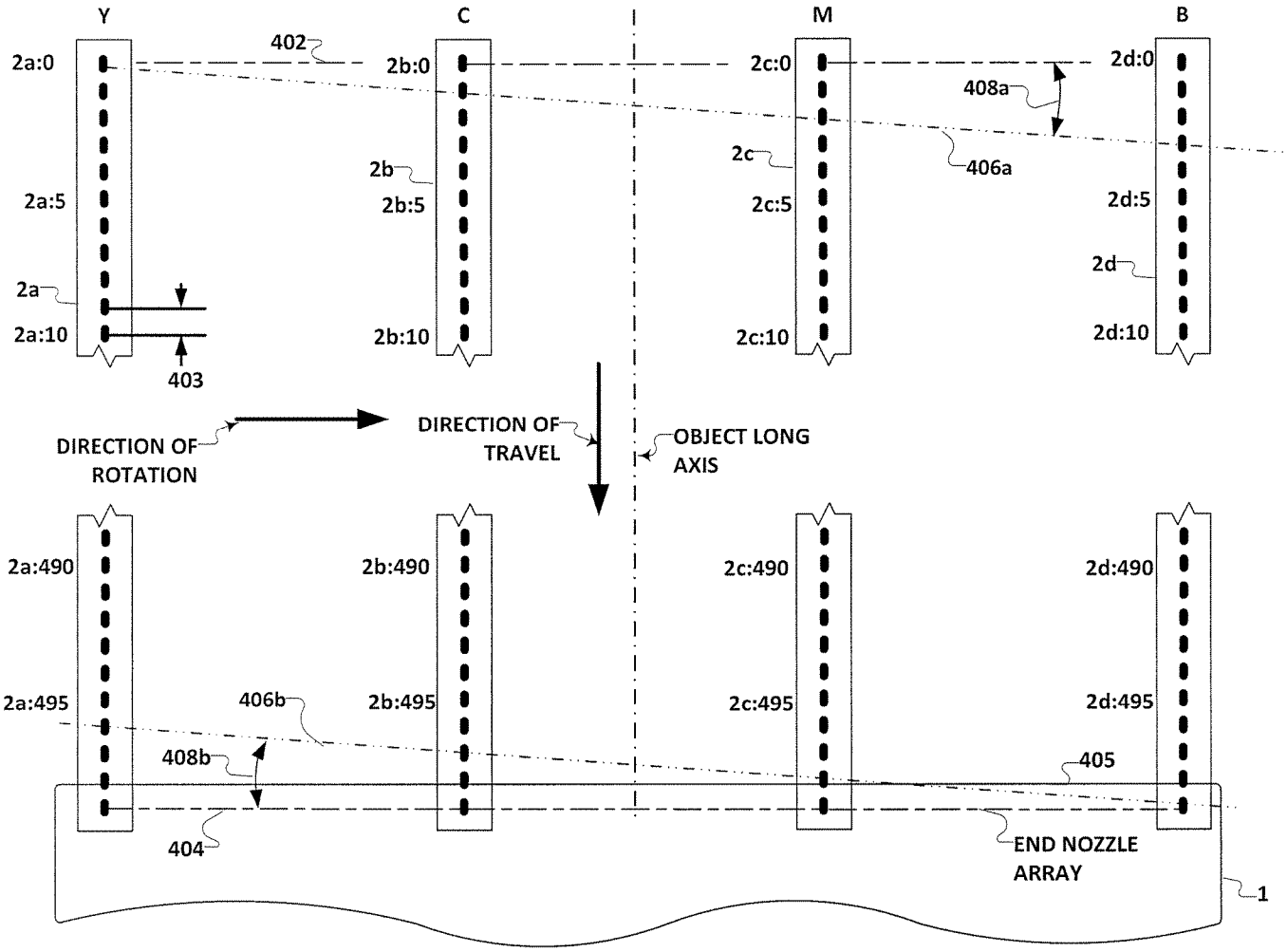
FIG. 4C is a view of the configuration of FIG. 4 showing the object to be printed advanced axially.

FIG. 4B depicts the trailing end 405 of the object 1 approaching the end of nozzle array 404. The object 1 is sufficiently axially advanced such that the last usable nozzle 2a:496 of printhead 2a is available for firing. FIG. 4c illustrates the object 1 at the end of the nozzle array 404, sufficiently axially advanced such that the last usable nozzle 2d:499 of the last printhead 2d is available for firing. Accordingly, as the trailing end 405 nears the end of the nozzle array 404, the last usable nozzles 2a:496, 2b:497, 2c:498, and 2d:499 define an angled line 406b. The angle 408b defined by angled line 406b represents a section within which nozzles 407 are unusable.

Figure 5:
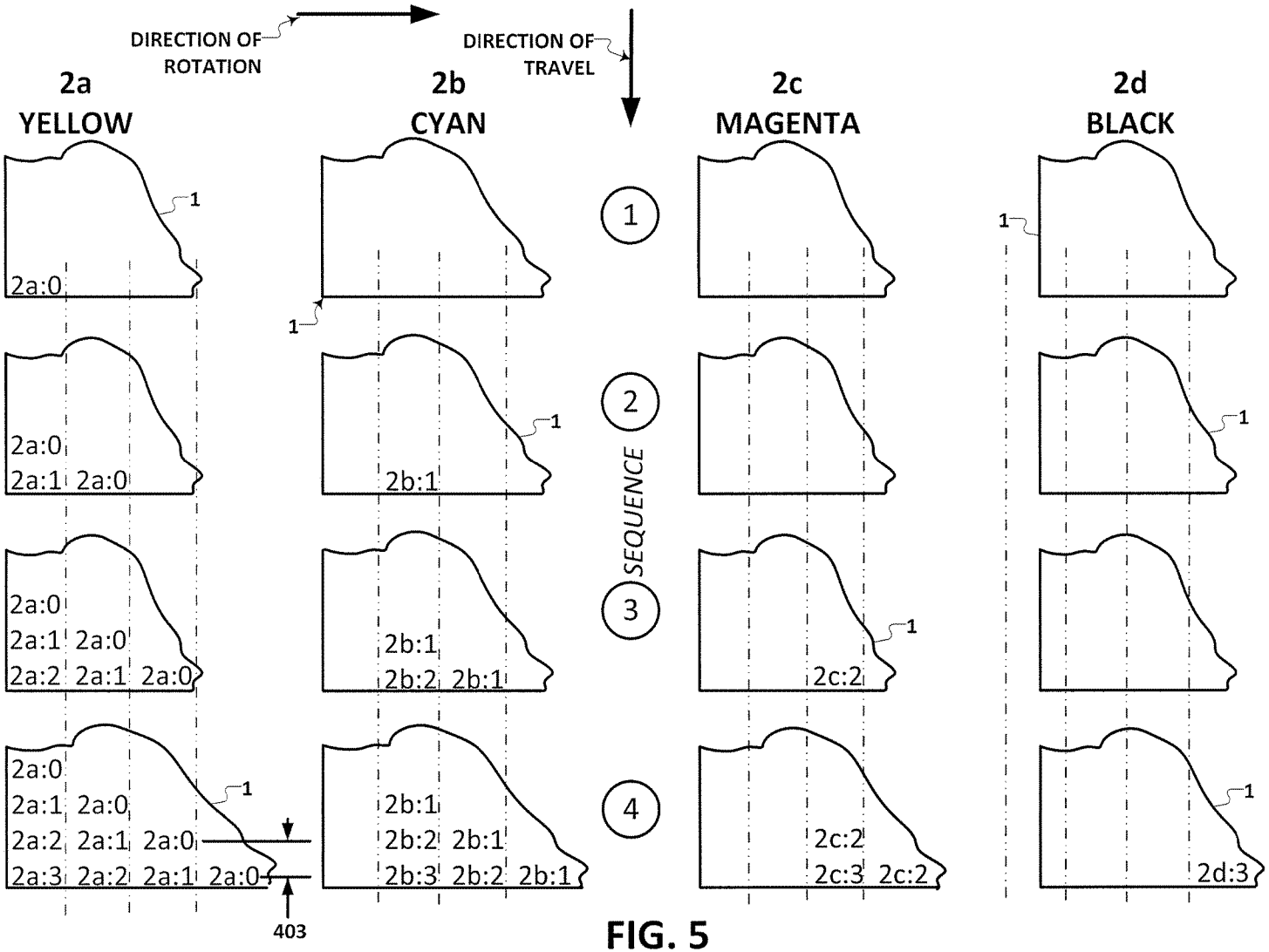
FIG. 5 illustrates an exemplary print pattern obtained by the method described herein.

FIG. 5 illustrates the deposition scheme for the arrangement depicted in FIGS. 4 through 4C. Dots 2a:0-2d:499 correspond to the nozzle position of the nozzle from which the dot was deposited and a sequence is one revolution of the object. For example, for the first printhead 2a in the first sequence. first dot 2a:0 printed is from the first nozzle 2a:0, followed by the first 2a:0 and second 2a:1 nozzles (SEQUENCE 2), then the first 2a:0, second 2a:1 and third 2a:2 nozzles (SEQUENCE 3), then the first 2a:0, second 2a:1, third 2a:2 and fourth 2a:3 nozzles (SEQUENCE 4); and so on. The object 1 is smoothly and continuously advanced along the line of travel while being rotated with respect to the printheads 2.

Figure 5A:
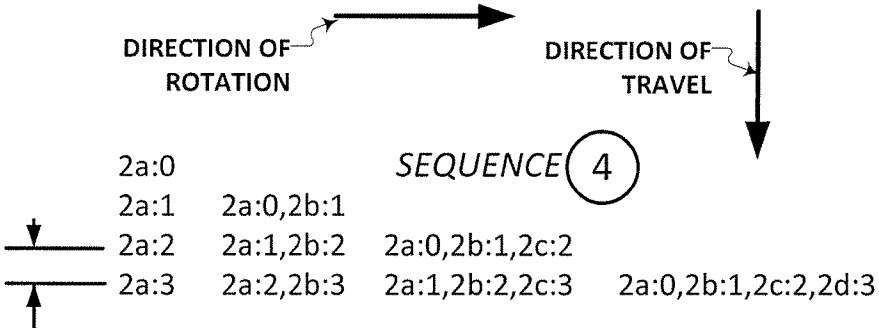
FIG. 5A illustrates an exemplary print pattern obtained by the method described herein.

Similarly, for the second printhead 2b, the first dot 2b:1 is from the second nozzle 2b:1 doesn't occur until Sequence 2, followed by the second 2b:1 and third 2b:2 nozzles (SEQUENCE 3), then the second 2b:1, third 2b:2 and fourth 2b:3 nozzles (SEQUENCE 4), then the second 2b:1, third 2b:2, fourth 2b:3 and fifth 2b:4 nozzle (not shown) (SEQUENCE 5: not shown), and so on. The first dot 2c:2 to be printed by the third printhead 2c is from the third nozzle 2c:2 (SEQUENCE 3), followed by the third 2c:2 and fourth 2c:3 (SEQUENCE 4), then the third 2c:2, fourth 2c:3 and fifth 2c:4 (not shown) (SEQUENCE 5: not shown), then the third 2c:2, fourth 2c:3, fifth 2c:4 (not shown) and sixth 2c:5 (not shown) (SEQUENCE 6: not shown), and so on. The first dot 2d:3 printed by the fourth printhead 2d—in this example—is from the fourth nozzle 2d:3 (SEQUENCE 4), followed by the fourth 2d:3 and fifth 2d:4 (not shown) (SEQUENCE 5: not shown), then the fourth 2d:3, fifth 2d:4 (not shown) and sixth 2d:5 (not shown) (SEQUENCE 6: not shown), and so on. For illustrative purposes, FIG. 5a is a composite view illustrating the nozzle firing scheme during SEQUENCE 4 from all printheads 2a-2d.

Figure 5F:
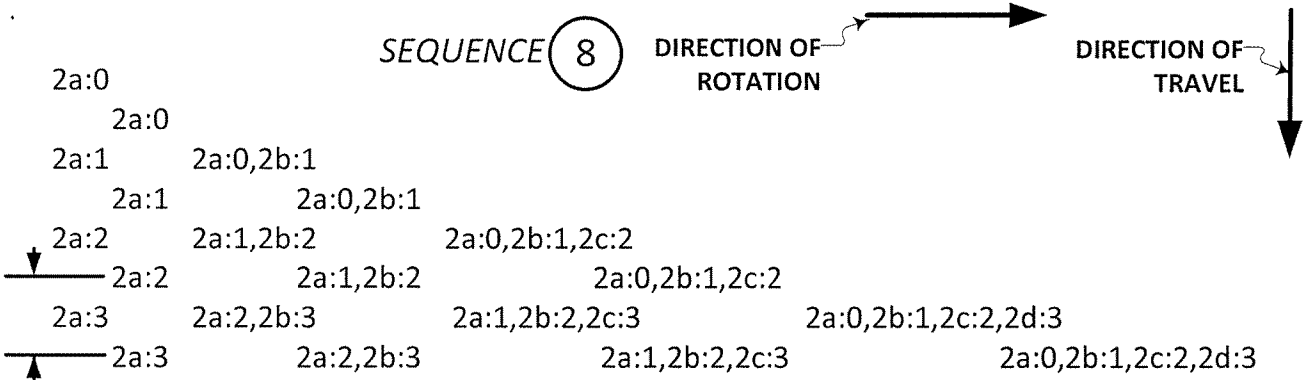
FIG. 5F illustrates an alternate print pattern obtained by the method described herein.
Figure 5B:
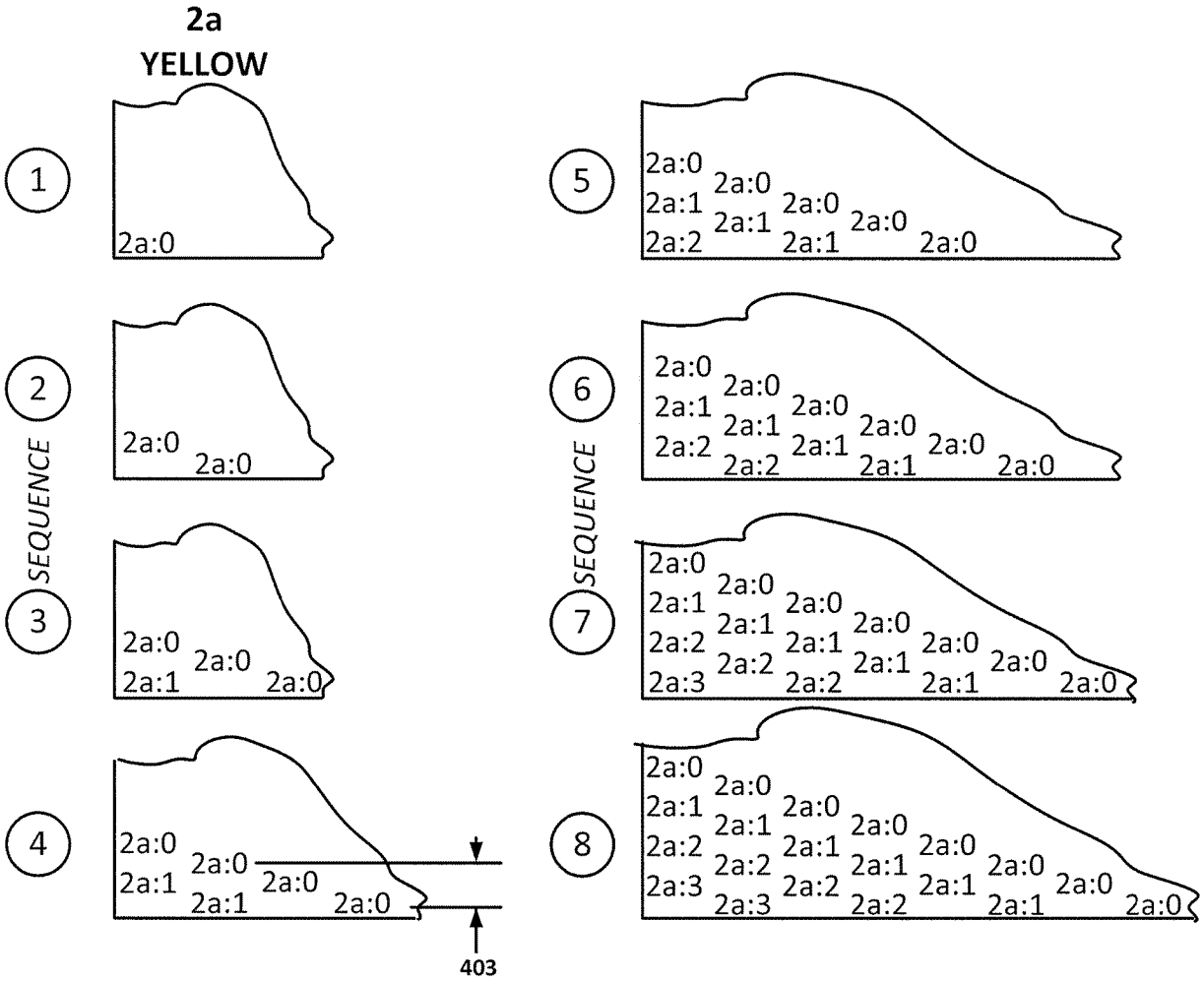
FIG. 5B illustrates an exemplary print pattern from the first printhead obtained by the method described herein.

FIG. 5B presents the concept of an axially interlaced nozzle firing scheme, starting with a possible pattern deposition from the first printhead 2a. In this example, the printhead 2a native resolution 403 is increased in the axial direction by having each nozzle 2a:0-2a:499 fire twice in succession such that a second dot is deposited at roughly half the nozzle spacing that defines native resolution 403. Meanwhile, the object 1 is continuously axially advanced through the nozzle array and rotating. This requires timing the object 1 axial and rotary motions appropriately, which also controls the circumferential print resolution. Those skilled in the art will appreciate that the rotation speed will need to be slowed compared to a non-interlaced technique in order insure the second firing is properly deposited. Although requiring more time than only using the printhead native resolution 403, it is still substantially faster than the current state-of-the-art technology described above since the object is not axially advanced by indexing.

Figure 5C:
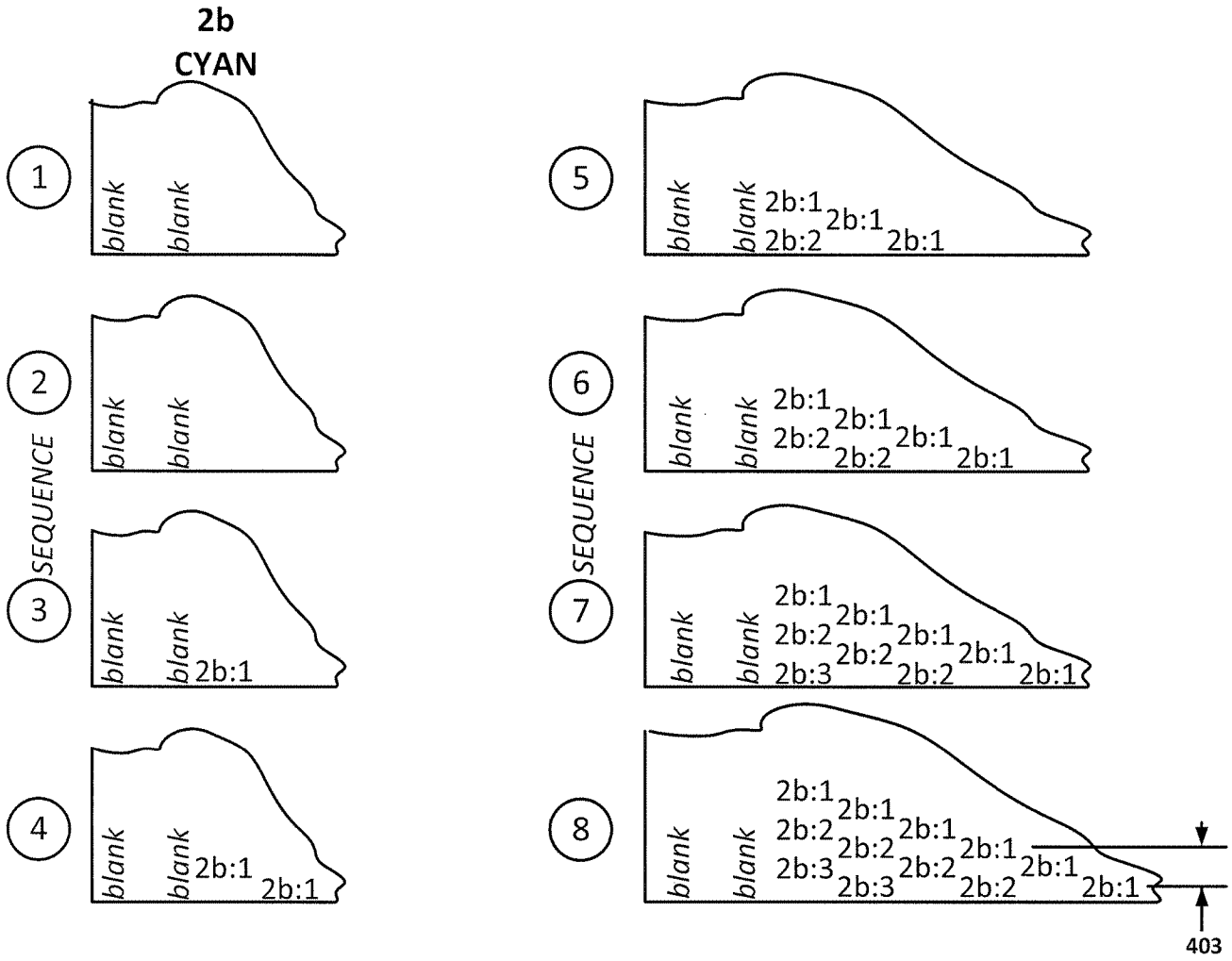
FIG. 5C illustrates an exemplary print pattern from the second printhead obtained by the method described herein.
Figure 5D:
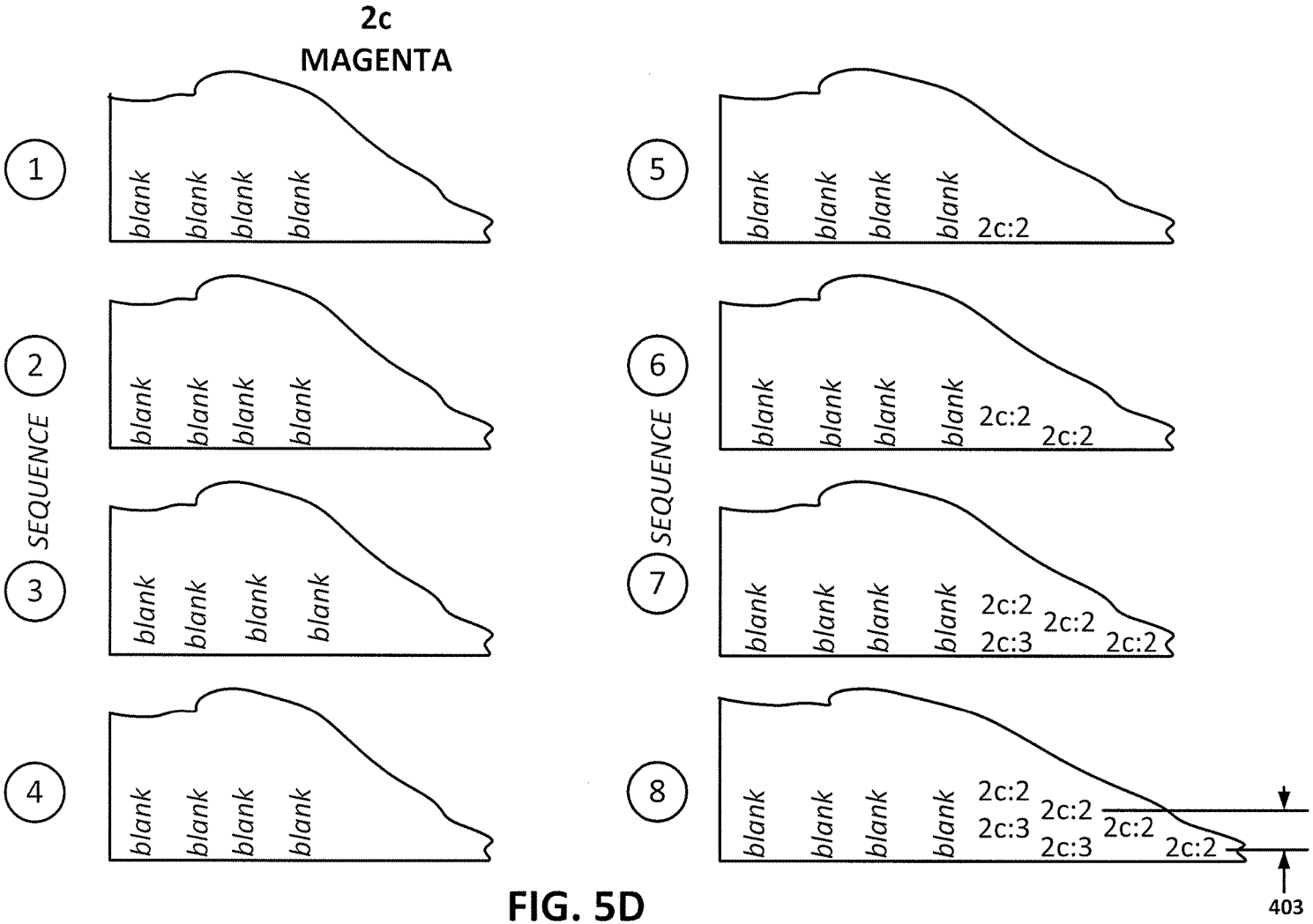
FIG. 5D is a plan view of an alternate print pattern from a third printhead as obtained by the method described herein.
Figure 5E:
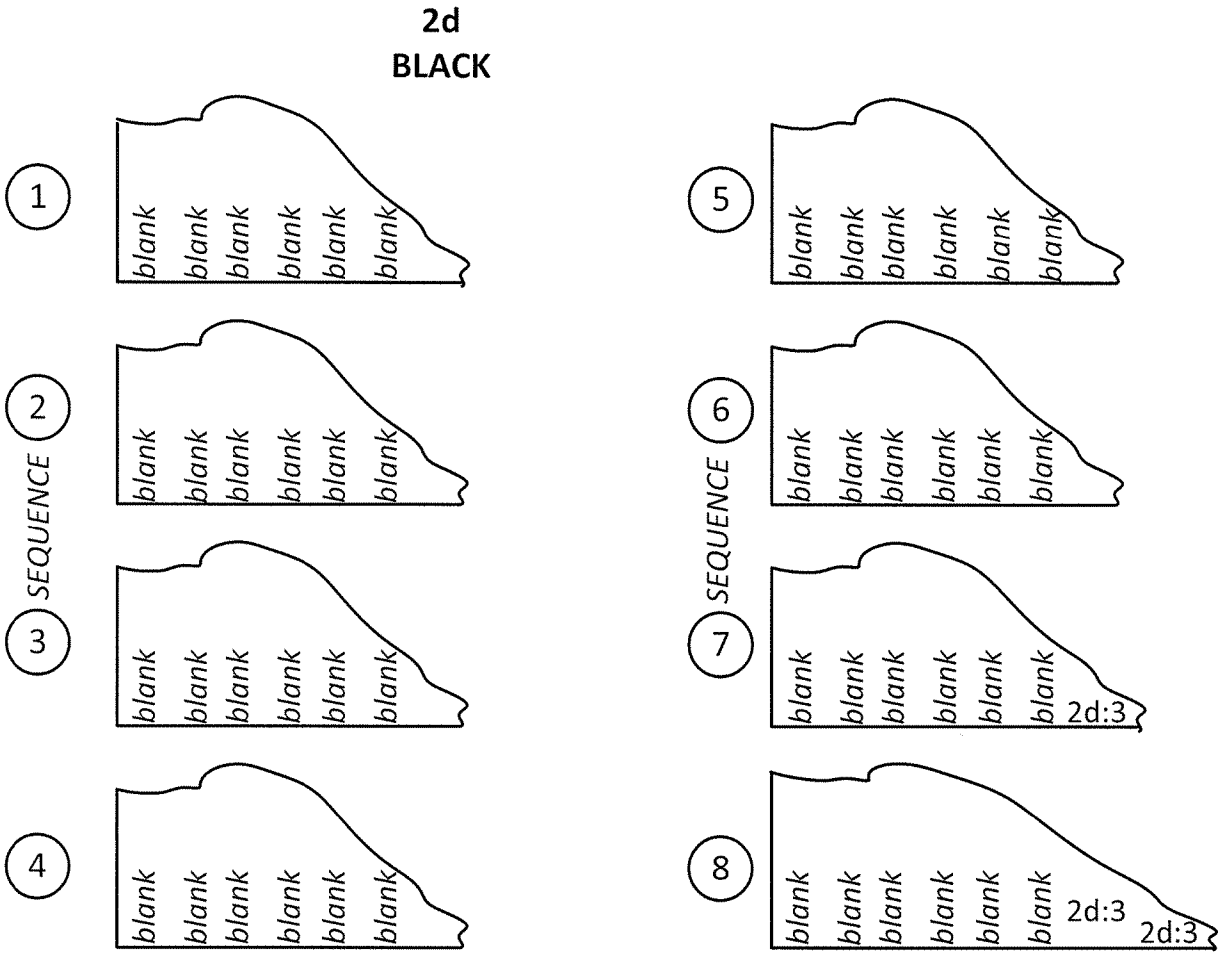
FIG. 5E is a plan view of an alternate print pattern from a fourth printhead as obtained by the method described herein.

FIG. 5C illustrates the corresponding exemplary pattern deposition from the second printhead 2b. FIG. 5d illustrates the corresponding possible print pattern from the third printhead 2c. FIG. 5e illustrates the corresponding possible print pattern from the fourth printhead 2d. For illustrative purposes, FIG. 5f is a composite view illustrating the nozzle firing scheme during SEQUENCE 8, from all printheads 2a-2d. It will be appreciated that since the number of sequences corresponds to the number of revolutions, there may be as many sequences as is necessary to complete deposition of ink comprising the image depending on the length of the print area.

Figure 6:
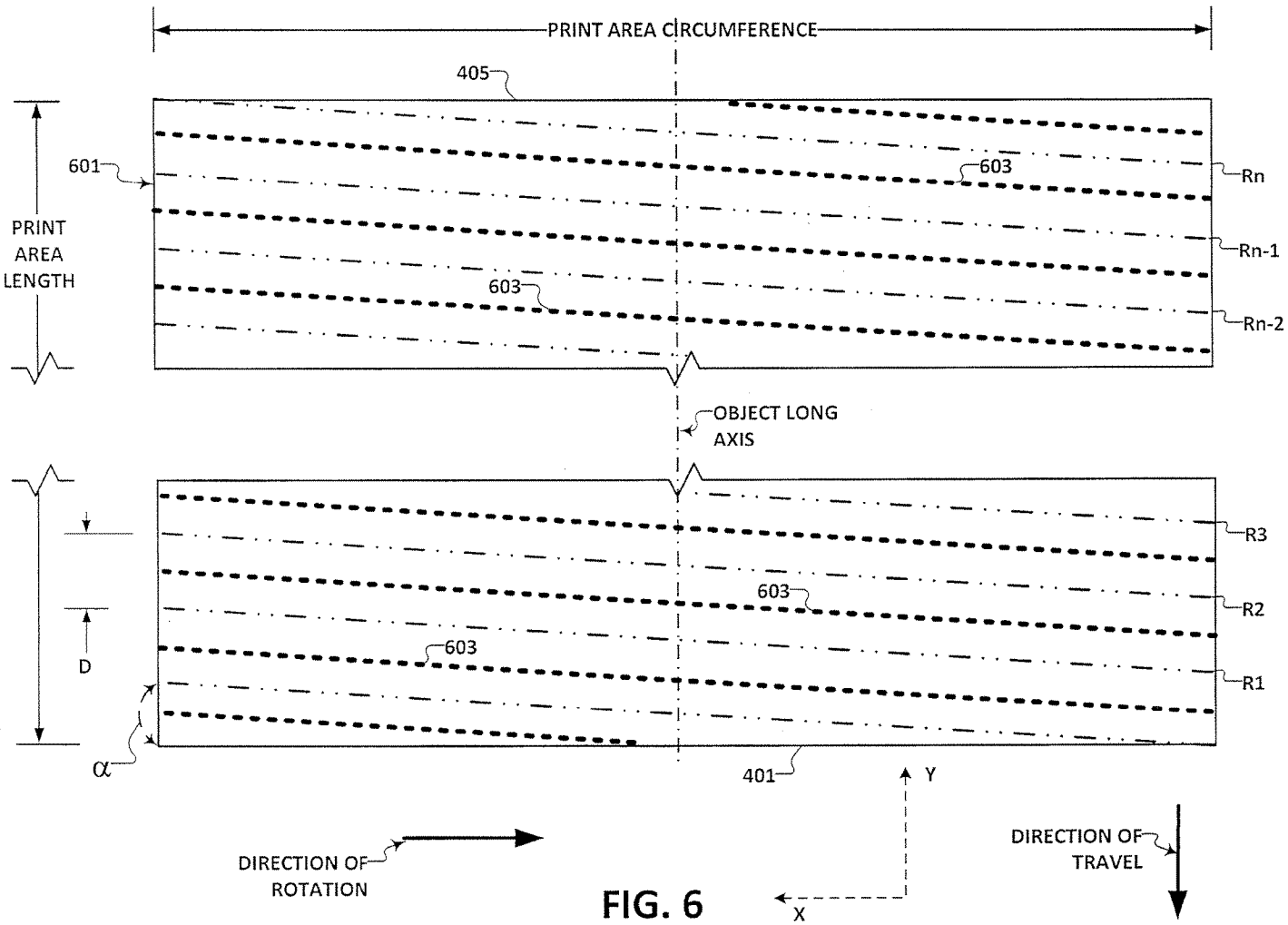
FIG. 6 illustrates a helical ink deposition pattern created by the method described herein.

FIG. 6 shows the deposition pattern for printhead 2a mapped to a flattened image 601 which may be stored in a computer memory and comprises a plurality of pixels. It will be appreciated that a corresponding deposition pattern from the second printhead 2b is shifted one pixel to the right of the deposition from the first printhead 2a; the third 2c and fourth 2d printheads follow suit shifting right an additional one pixel each. Each revolution R1 through Rn, the image 601 map is axially advanced in the +Y direction at an advance distance D equal to the distance the object 1 is axially advanced through the nozzle area. Dots 603 are plotted that correspond to the dots deposited when a nozzle fires. The drawing presents only one line of dots 603 for clarity but it will be understood that each nozzle in a column of nozzles will deposit a similar row of dots 603 disposed either above or below those shown in the drawing depending on which nozzle 407 is being mapped.

Figure 6A:
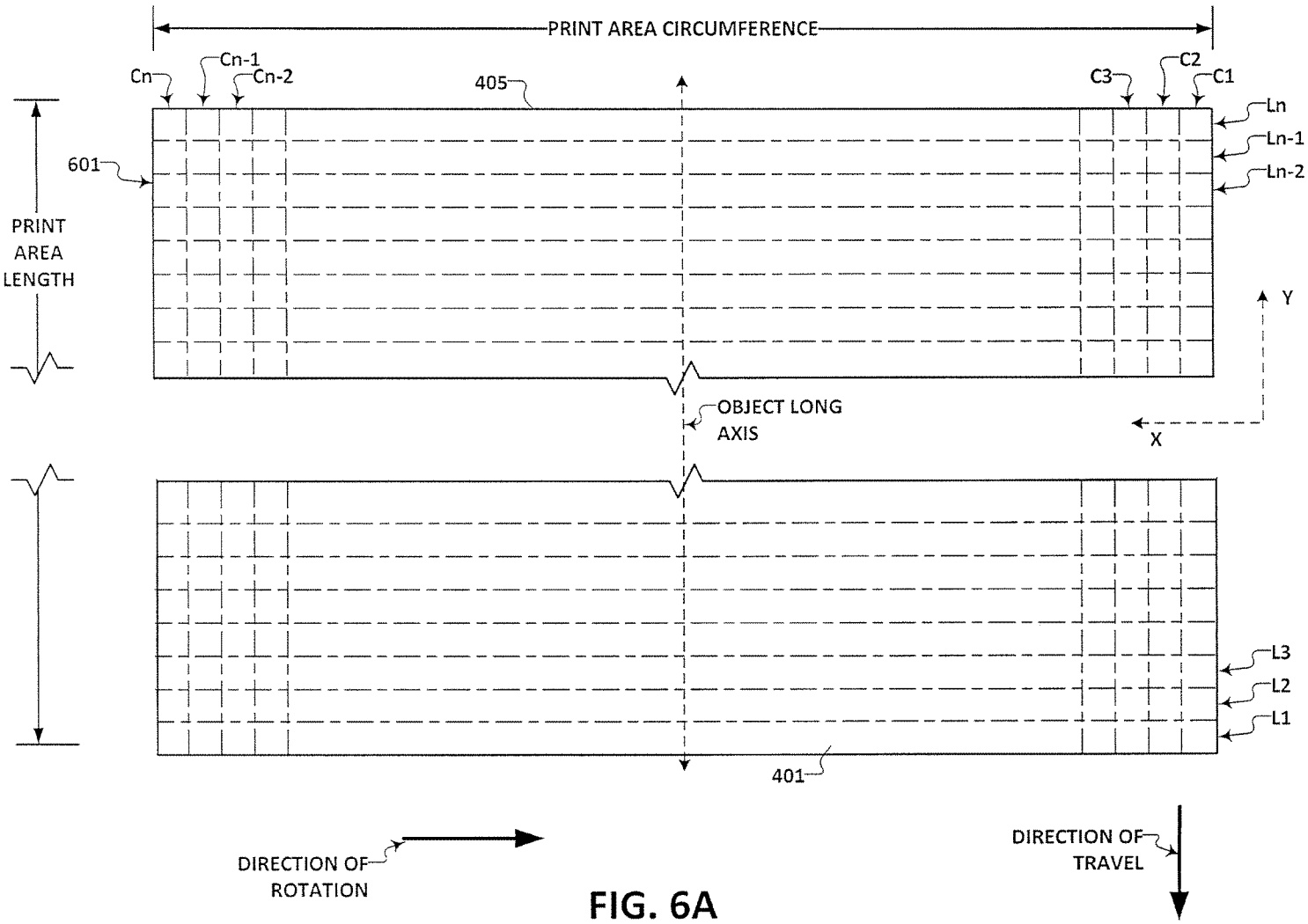
FIG. 6A shows how an image to be printed is defined as a matrix.

The image 601 is subsequently printed along a helix angle α, which is determined by the horizontal (X) print resolution and axial (Y) resolution and may be found by $$\propto = \tan^{-1} D/C$$

where C is the circumference of the print area. The image 601 advance distance D, measured in pixels, is a function of the desired print resolution in the axial (Y) direction and is determined by the number, N, of lines (FIG. 6A: L1 through LN) comprising an image divided by the desired resolution, e.g., 720p.

For example, assuming a cylindrical object comprises a diameter of 2.6 inches, $C=2.6\times\pi=8.168$ in. Circumferential density is roughly 1000 dpi resulting in 8168 pixels per line. To make everything integer multiples, 8192 (pixel divider of 20) pixels may be used. Axial motion may be defined as $1+(L_n \div (P\times I)) \div 720$, where $L_n$ is the number of image lines, P is the desired number of passes or times the object will be passed under the printhead(s), I is the desired multiple of interlacing, e.g., 2× or 4×. 720 is the desired pixel density in the axial direction.

Figure 7:
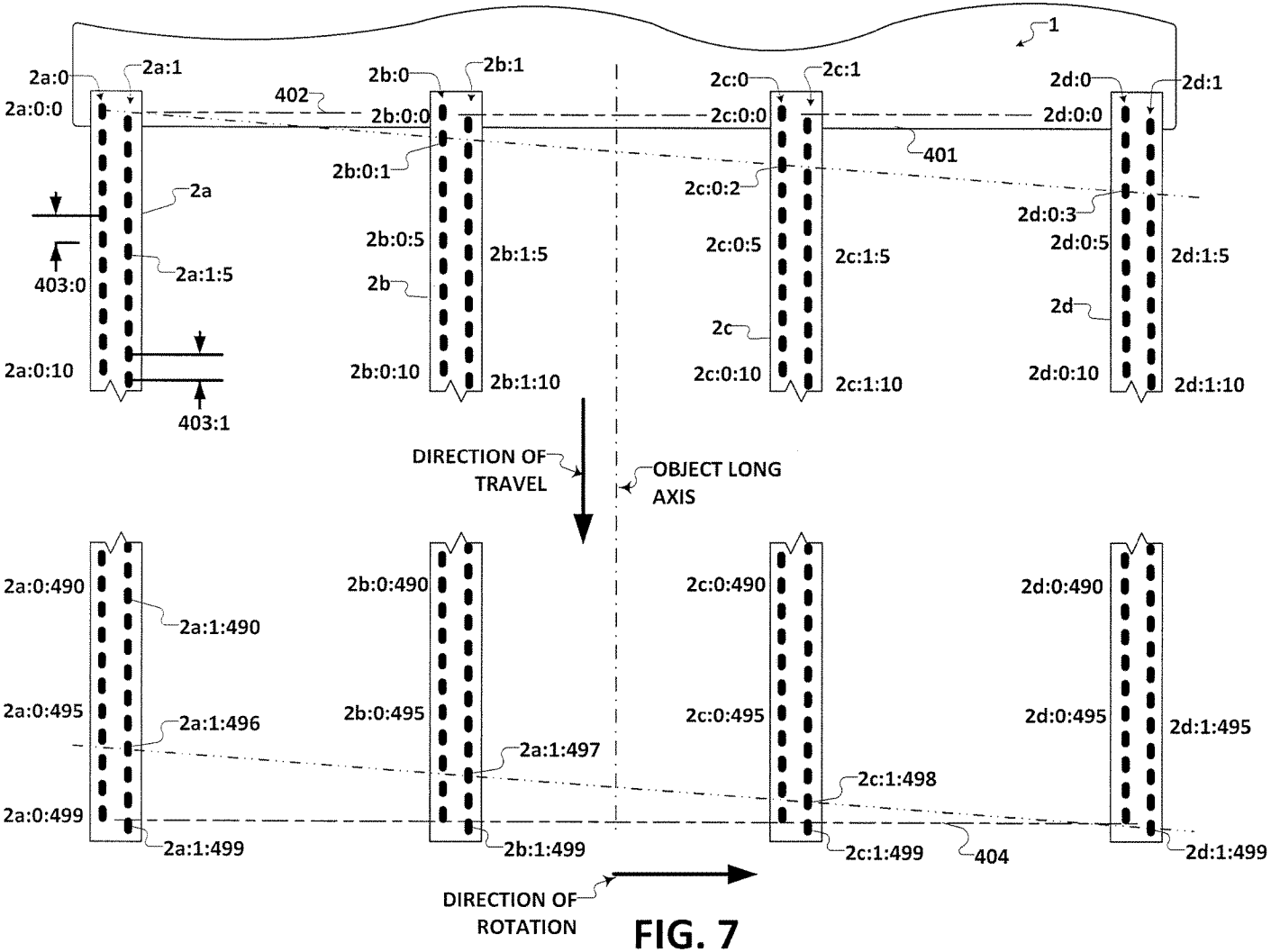
FIG. 7 depicts a second printhead configuration.

FIG. 7 illustrates another exemplary embodiment in which each nozzle 2*a*-2*d* comprises two nozzle columns 2:0 and 2:1. As will be explained below, such a configuration may be used for both axial and circumferential interlacing. It will be appreciated that more columns of nozzles may be employed. Further, the present printing technique may be used in a printing system configured with more than one printhead per color.

In this figure, the leading end 401 of the object 1 is starting to the start of the nozzle array 402. It is necessary here to designate certain nozzles the printheads 2*a*-2*d* unusable for the same reason as described above with respect to the single nozzle column configuration. In this example, the unused nozzles are 2*a*:0:497, 2*a*:0:498, 2*a*:0:499, 2*a*:1:497, 2*a*:1:498, 2*a*:1:499, 2*b*:0:0, 2*b*:1:0, 2*b*:0:498, 2*b*:0:499, 2*b*:1:498, 2*b*:1:499, 2*c*:0:0, 2*c*:0:1, 2*c*:1:0, 2*c*:1:1, 2*c*:0:499, 2*c*:1:499, 2*d*:0:0, 2*d*:0:1, 2*d*:0:2, 2*d*:1:0, 2*d*:1:1, 2*d*:2:2. The total number of unused nozzles in each printhead 2*a*-2*d* is again identical, but their location within the printheads 2*a*-2*d* differs. In this example, that number is six per printhead 2*a*-2*d* (three in each column), but the actual number in practice is dependent upon the print resolution desired, printhead native resolution 403 and firing frequency, desired axial printhead nozzle interlacing, e.g., 2 times, 4 times, etc., desired circumferential printhead nozzle interlacing, as well as the resultant axial and rotary motion speeds of the object 1 beneath the printheads 2*a*-2*d*.

FIG. 7 shows the first nozzle 2*a*:0:0 within the first printhead 2*a* at the start of the nozzle array 402 firing first, when the object leading end 401 (or the leading edge of the print area) passes underneath. In this example each printhead contains one thousand nozzles 407, five hundred in each of the respective first columns and five hundred in the respective second columns. The second printhead 2*b* in this example contains two unusable nozzles 2*b*:0:0, 2*b*:1:0 near the start of the nozzle array 402, and four unusable nozzles 2*b*:0:498-2*b*:1:499 near the end of the nozzle array 404 six in total. The third printhead 2*c* contains four unusable nozzles 2*c*:0:0-2*c*:1:1 at the beginning of the printhead 2*a*-2*d* nozzles 2*a*:0:0-2*d*:1:499 and two unusable nozzles 2*c*:0:499, 2*c*:1:499 at the end of printhead 2*a*-2*d* nozzles 2*a*:0:0-2*d*:1:499, six in total. The fourth printhead 2*d* contains six unusable nozzles 2*d*:0:0-2*d*:1:2, all at the beginning of the printhead 2*a*-2*d* nozzles 2*a*:0:0-2*d*:1:499.

Figure 7A:
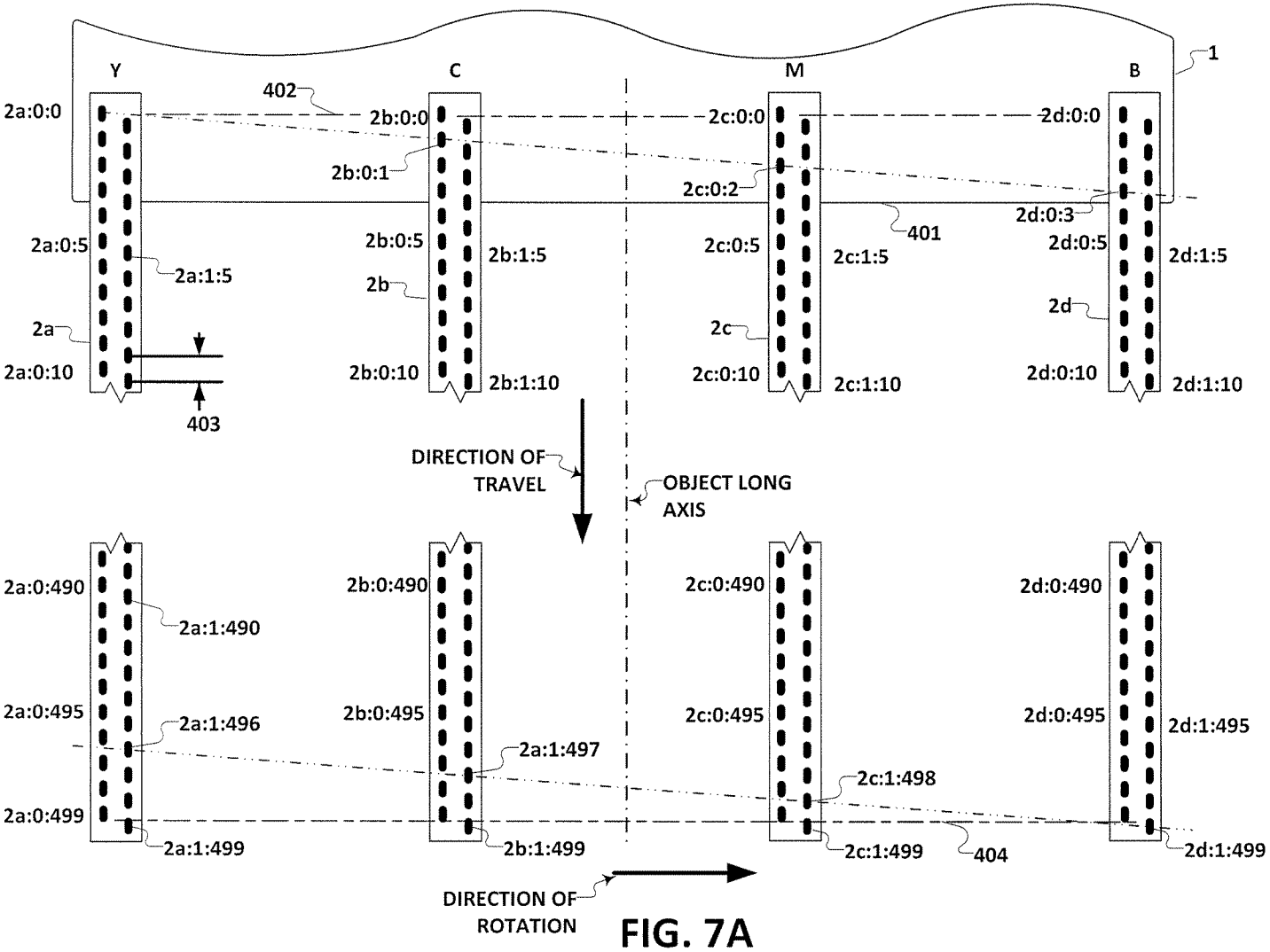
FIG. 7A depicts the configuration of FIG. 7 with the object axially advanced of the method described herein.
Figure 7B:
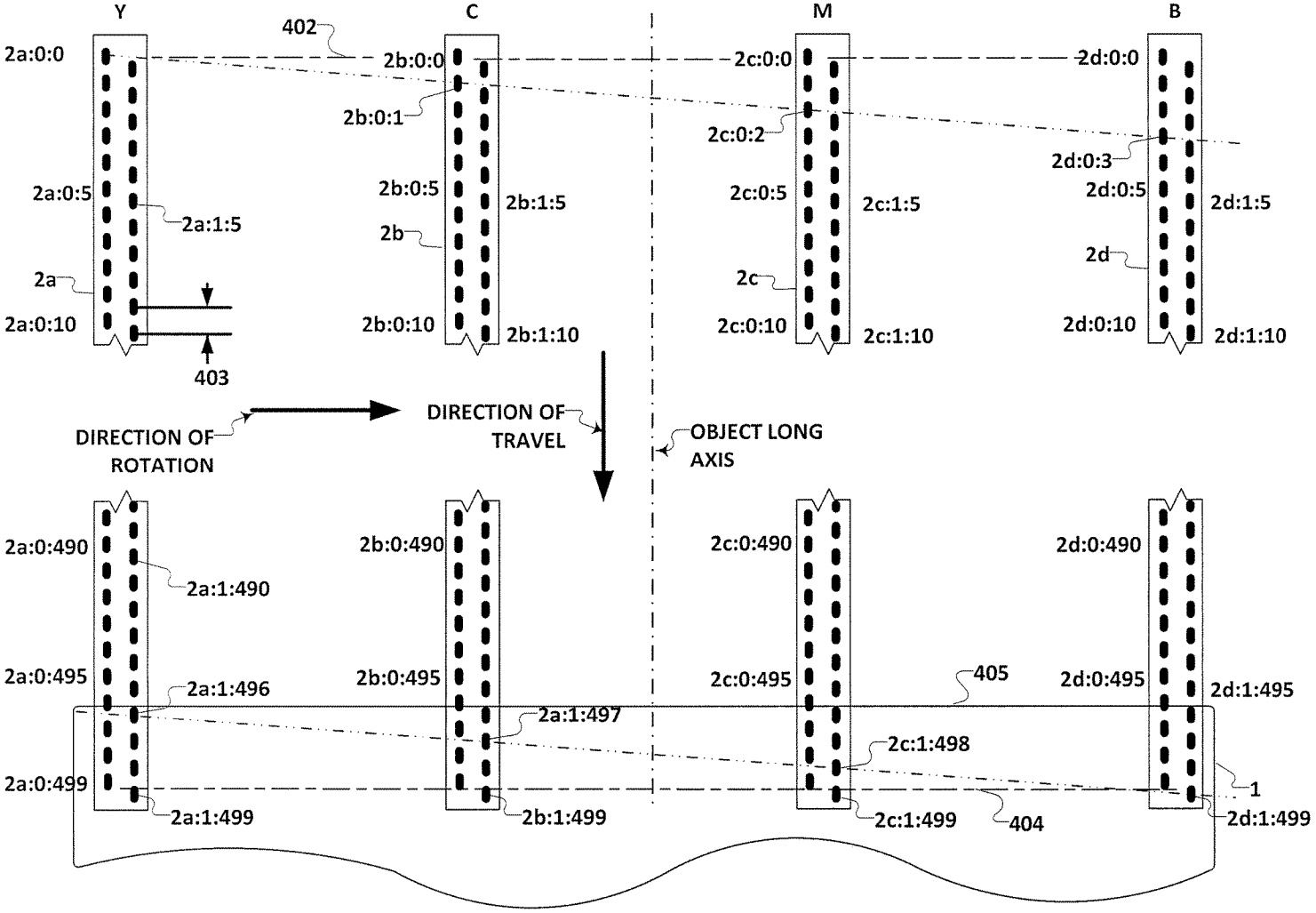
FIG. 7B depicts the configuration of FIG. 7 with the object axially farther advanced of the method described herein.

FIG. 7A depicts the beginning of the object 1 to be printed continuing to pass beneath the beginning of the printhead nozzles 2*a*:0:0-2*d*:1:499. Herein is illustrated, a point where the object 1 to be printed is sufficiently axially advanced such that all printhead nozzles 2*a*:0:0-2*d*:1:499 are available for firing. In this example this occurs at the third nozzle 2*d*:1:2 of the second row 2*d*:1 of the fourth printhead 2*d*. FIG. 7B depicts the end of the object 1 to be printed approaching the end of the printhead 2*a*-2*d* nozzles 2*a*:0:0-2*d*:1-499. Herein is illustrated the object 1 to be printed sufficiently linearly advanced such that in this example the last usable nozzle 2*a*:1:496 of the first printhead 2*a* is available for firing, if necessary.

Figure 8:
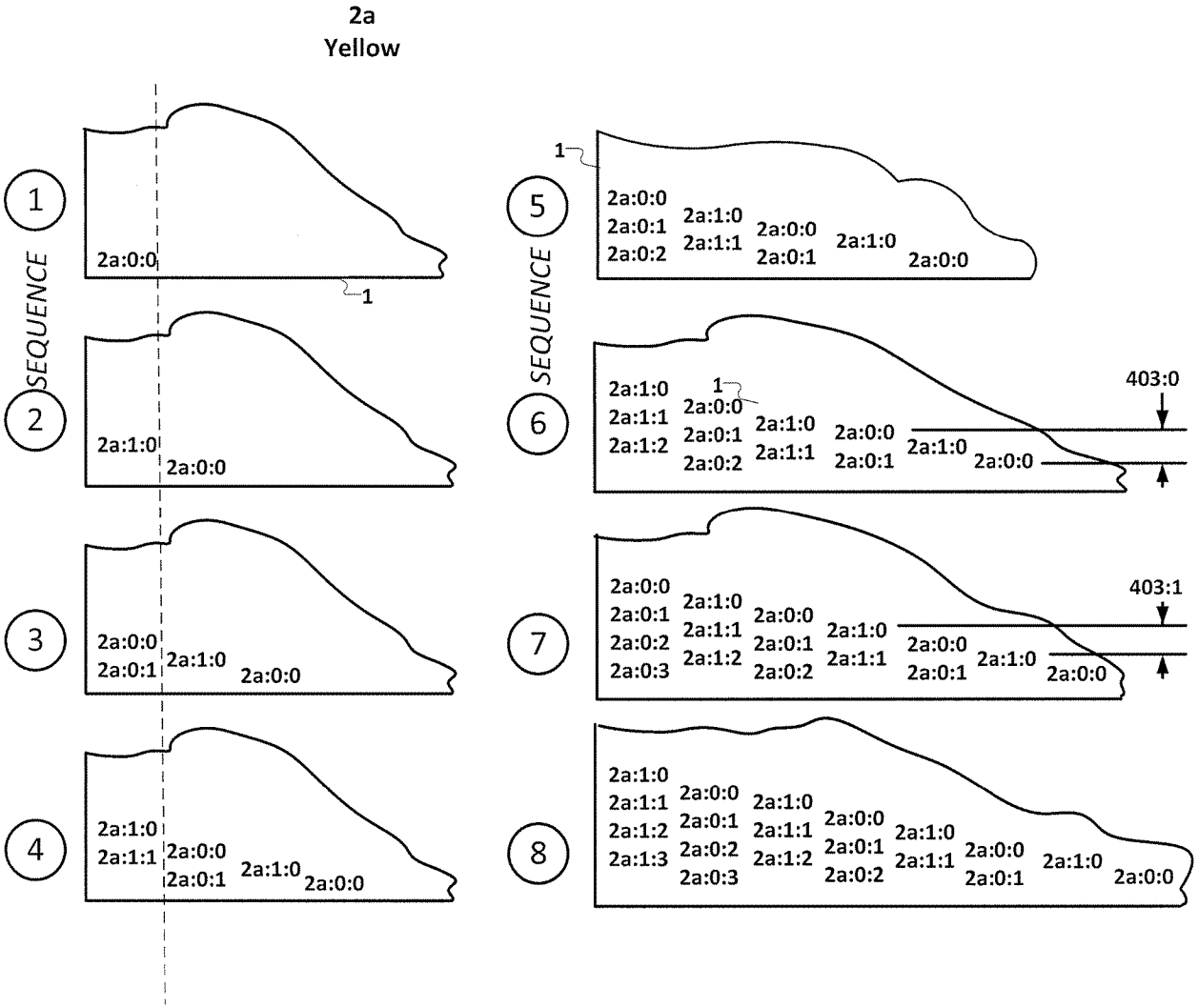
FIG. 8 illustrates an exemplary print pattern for the first printhead obtained by the method described herein.

FIG. 8 shows the firing sequence for printhead 2*a* using circumferential interlacing, utilizing the two columns 2*a*:0, 2*a*:1 of nozzles. Although two columns are shown, the number of nozzle columns or the number of printheads for each color is variable. This embodiment advantageously allows nozzle columns 2*a*:0, 2*a*:1 to print every other column image column (FIG. 6A: C1-Cn), i.e., column 2*a*:0 fires on odd-numbered columns (C1, C3, etc.) while column 2*a*:1 fires on even-numbered columns (C2, C4, etc.). This allows faster rotational speed since that is normally limited by resolution and firing frequency of the nozzles. Here the first dot is printed by the first nozzle 2*a*:0:0 of the first row 2*a*:0 of the first printhead 2*a* (SEQUENCE 1), followed by the first nozzle 2*a*:1:0 of the second row 2*a*:1 of the first printhead 2*a* (SEQUENCE 2), in such a manner that the axial distance between the two is determined by the helical angle α and the distance between the nozzle columns 2*a*:0, 2*a*:1, but never exceeds ½ pixel at the image resolution. Since the helical angle α is constant throughout the print, this axial distance relationship is constant over the entire image 601. The next deposition is from the first 2*a*:0:0 and second 2*a*:0:1 nozzles of the first row 2*a*:0 of the first printhead 2*a*, firing at the native printhead resolution 403, and so on.

Figure 8A:
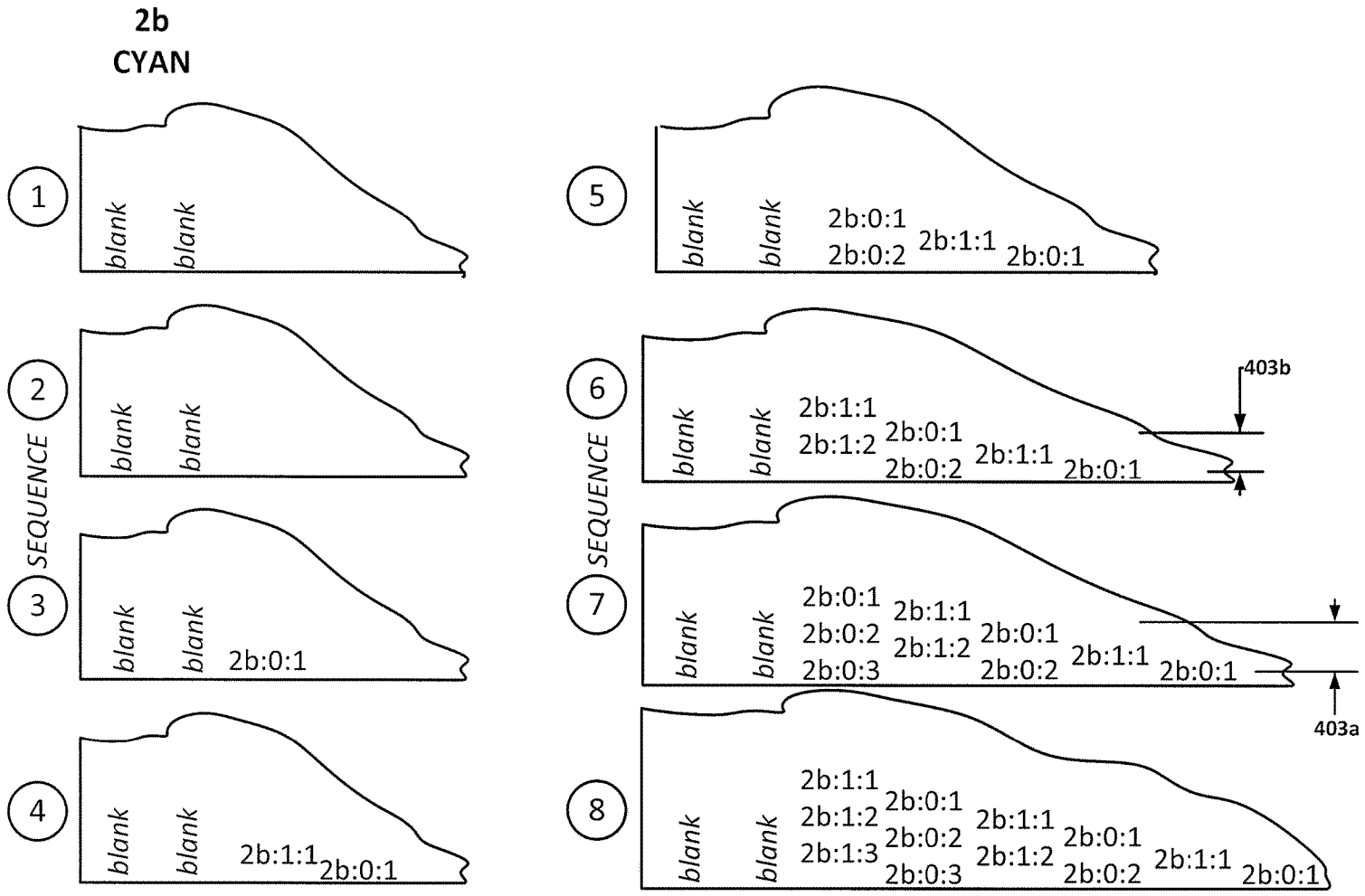
FIG. 8A illustrates an exemplary print pattern for the second printhead obtained by the method described herein.
Figure 8B:
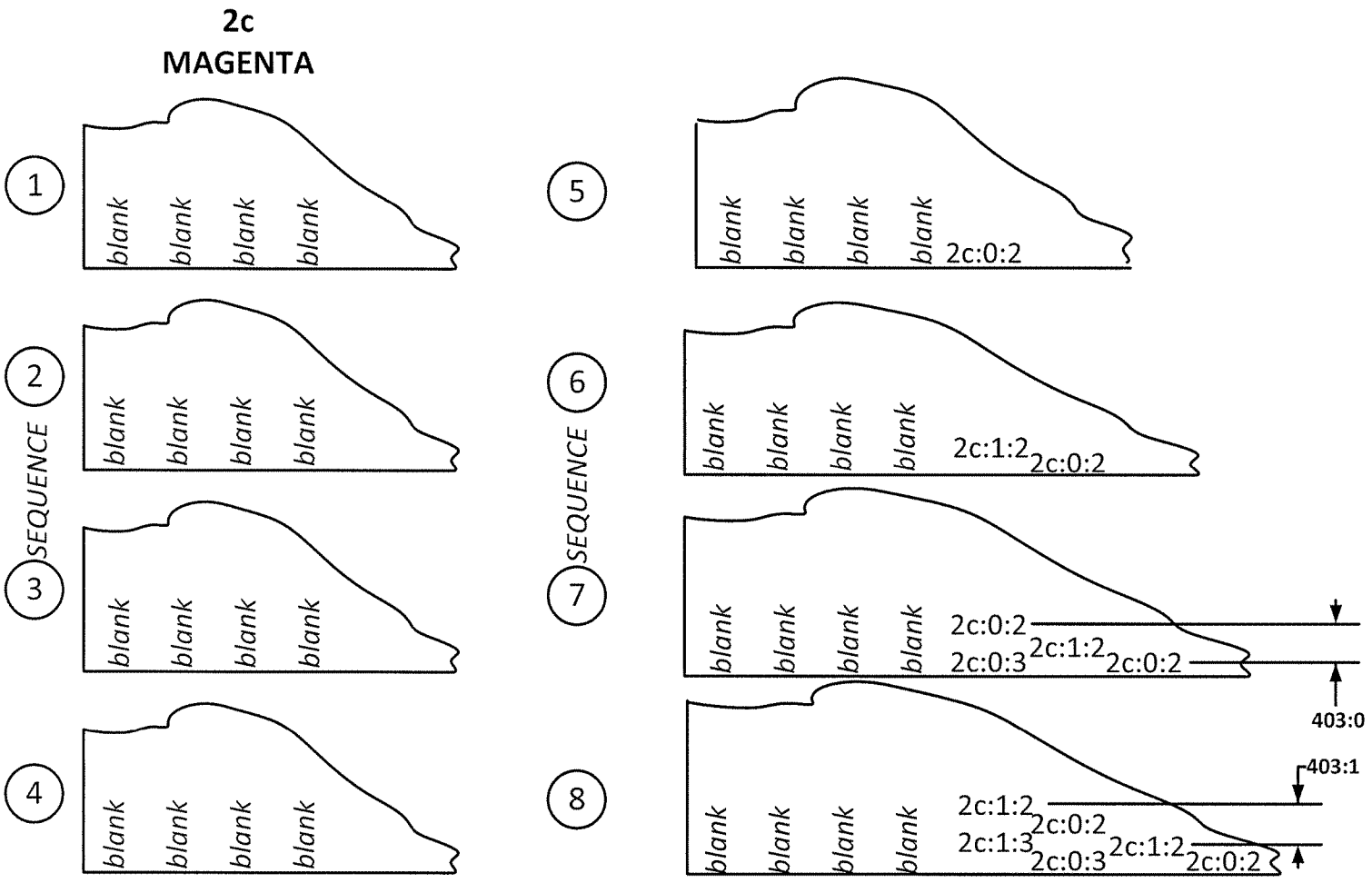
FIG. 8B illustrates an exemplary print pattern for the third printhead obtained by the method described herein.
Figure 8C:
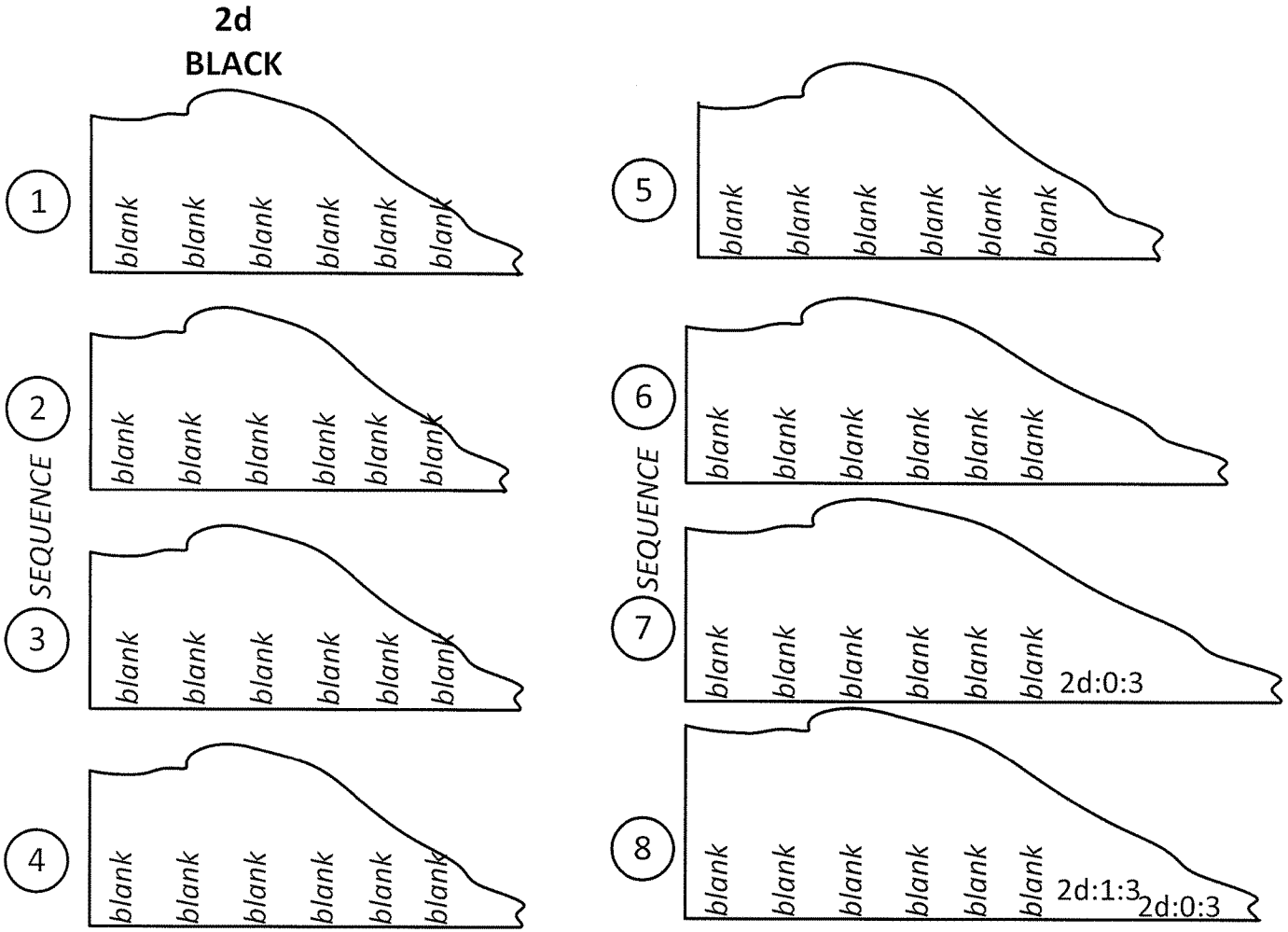
FIG. 8C illustrates an exemplary print pattern for the fourth printhead obtained by the method described herein.

FIG. 8A illustrates SEQUENCES 1 through 8 of the second printhead 2*b*, whereas the pattern begins to print at SEQUENCE 3, advanced in this example axially one nozzle 2*b*:0:1 from the first nozzle 2*a*:0:0 of the first printhead 2*a*. The SEQUENCE 8 print deposition is as shown: the first two rows are blank, with the remaining rows advanced one nozzle from the first printhead 2*a*. FIG. 8B illustrates SEQUENCES 1 through 8 of the third printhead 2*c*, whereas the pattern begins to print at SEQUENCE 5, advanced in this example two nozzles from the first printhead 2*a*. The SEQUENCE 8 print deposition is as shown: the first four columns are blank, with the remaining columns advanced two nozzles from the first printhead 2*a*. FIG. 8C illustrates SEQUENCES 1 through 8 of the fourth printhead 2*d*, the pattern begins to print at SEQUENCE 7, advanced in this example three nozzles from the first printhead 2*a*. The SEQUENCE 8 print deposition is as shown: the first six columns are blank, with the remaining columns advanced three nozzles from the first printhead 2*a*. FIG. 8D is a composite view illustrating the nozzle composition 2*a*:0:0-2*d*:1:3 of the twenty dots from all four printheads 2*a*-2*d* at SEQUENCE 8.

Figure 8E:
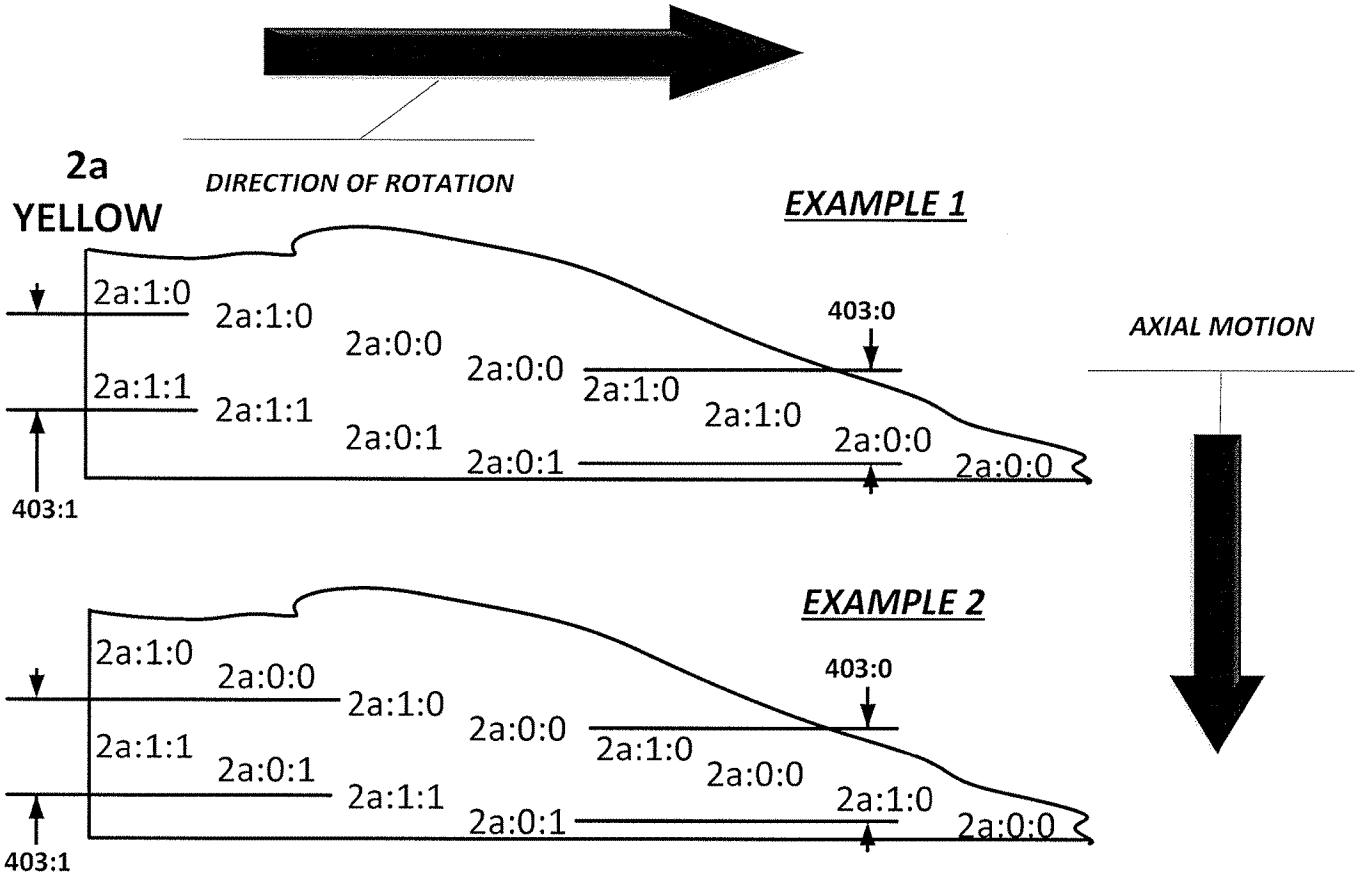
FIG. 8E summarizes two print patterns using two different interlacing techniques from a first printhead.

FIG. 8E illustrates two additional possible deposition patterns of the first printhead 2*a* obtained by a combination of axial and circumferential interlacing. In EXAMPLE 1 the first column 2*a*:0 is axially interlaced in such a manner as to create a deposition pattern similar to that illustrated in FIG. 5B, where the axial spacing between nozzles 407 is half that of the actual printhead native resolution 403. In turn, the second column 2*a*:1 is similarly axially interlaced, and provides circumferential interlacing with the first row 2*a*:0, in effect allowing for an axial print resolution four times that of the native resolution 403 of columns 2*a*:0, 2*a*:1. EXAMPLE 2 illustrates another possible deposition result where the axial interlacing of both columns 2*a*:0, 2*a*:1 is such that a staggered pattern emerges. The circumferential print resolution continues to be controlled by the relationship of axial to rotary motion. The manner in which each printhead 2 prints on the object 1 remains as illustrated in FIG. 6, except here the value of the image 601/object 1 advance distance D, and therefore the helix angle α is determined by additional factors, namely axial/circumferential interlacing parameters.

To achieve interlacing in the axial direction, the object should be advanced in should be an odd number of lines (L1, L3, etc.). However, all advances must be equal. This is an inherent helical motion restriction. To achieve this in the printing system such as that shown and described above, an axial encoder may be slaved to the rotary encoder. The image advance determines the gear ratio between the rotary and axial motion.

In pre-processing, the digital image must be pre-shifted to compensate for the helical angle α. For example, each column Cn is shifted vertically in the opposite direction, but equal in magnitude corresponding to the helix angle α. The vertical shift in the Y direction (FIG. 6, 6A) needed at any pixel ($X_n$, $Y_n$) is $$Y_n\text{Shift} = \frac{D * X_n}{C}$$

In addition, pixels density, or dots density, should be an integer multiple of the number of revolutions per second or the number of subdivisions of a revolution.

As described above and shown in the associated drawings, the present invention comprises a method for continuous motion printing on cylindrical objects. While particular embodiments have been described, it will be understood, however, that any invention appertaining to the method described is not limited thereto, since modifications may be made by those skilled in the art, particularly in light of the foregoing teachings. It is, therefore, contemplated by the appended claims to cover any such modifications that incorporate those features or those improvements that embody the spirit and scope of the invention.

What is claimed is:

1. A method for printing a multicolor image onto a cylindrical printing area of an object having a longitudinal axis in a single printing pass using an array of printheads located around the longitudinal axis of the object comprising:

positioning the nozzles of each printhead in a column aligned with the longitudinal axis of the cylindrical printing area, the nozzles of the printheads being represented as 2*x:n*, where x is a letter representing one of the printheads of the array and where n is an integer from 1 to an integer representing the number of nozzles in each printhead;

advancing the cylindrical printing area along its longitudinal axis while simultaneously rotating it about the axis;

firing each of the printhead nozzles twice in succession beginning when the leading edge of the printing area enters the nozzle array to deposit successive color dots at half the nozzle spacing, the firing of the nozzles proceeding in successive sequences each producing successive overlapping helical deposition patterns, the first sequence in which x=a and n=1 comprising firing nozzle 2*a* followed by nozzles 2*b*, 2*c* up to the number of printheads in the array with n being incremented by 1 for each successive printhead in the array;

continuing to fire the nozzles as required to deposit color dots over each other in the successive overlapping helical deposition patterns as necessary to complete the image where n increases by 1 in each successive sequence through n=the number of nozzles in each printhead, whereupon n begins again at 1 until the image is completed; and withholding firing of selected printhead nozzles as required by the image.

2. The method of claim 1 in which each of the color dots deposited over each other are overlaid on one another.

3. The method of claim 1 in which each of the color dots deposited over each other is offset from its predecessor.

4. The method of claim 1 in which the rotating of the cylindrical printing area about its longitudinal axis is slowed to ensure that the second fired dots are properly deposited.

5. The method of claim 1 in which each printhead has two adjacent nozzle columns with adjacent nozzles and the adjacent nozzles are fired to deposit successive dots.

6. The method of claim 5 in which alternating adjacent nozzles are fired to print in alternating image columns.

7. The method of claim 5 in which each nozzle of each printhead column is fired a plurality of times in succession such that successive dots are deposited at locations between the nozzle spacing.

8. The method of claim 1 in which each printhead has a plurality of nozzle columns with adjacent nozzles and the adjacent nozzles are fired in succession across the columns.

9. The method of claim 8 in which alternating adjacent nozzles are fired to print in alternate image columns.

10. The method of claim 8 in which each nozzle of each printhead column is fired a plurality of times in succession such that successive dots are deposited at locations between the nozzle spacing.

11. A method for printing a multicolor image onto a cylindrical printing area of an object having a longitudinal axis in a single printing pass using an array of printheads located around the longitudinal axis of the object comprising:

positioning the nozzles of each printhead in a column aligned with the longitudinal axis of the cylindrical printing area, each printhead having two adjacent nozzle columns with adjacent nozzles and the adjacent nozzles are fired to deposit successive dots at half the nozzle spacing;

the nozzles of the printheads being represented as 2*x:n*, where x is a letter representing one of the printheads of the array and where n is an integer from 1 to an integer representing the number of nozzles in each printhead;

advancing the cylindrical printing area along its longitudinal axis while simultaneously rotating it about the axis;

firing each of the printhead nozzles twice in succession beginning when the leading edge of the printing area enters the nozzle array to deposit successive color dots at half the nozzle spacing, the firing of the nozzles proceeding in successive sequences each producing successive overlapping helical deposition patterns, the first sequence in which x=a and n=1 comprising firing nozzle 2*a* followed by nozzles 2*b*, 2*c* up to the number of printheads in the array with n being incremented by 1 for each successive printhead in the array;

continuing to fire the nozzles as required to deposit color dots over each other in the successive overlapping helical deposition patterns as necessary to complete the image where n increases by 1 in each successive sequence through n=the number of nozzles in each printhead, whereupon n begins again at 1 until the image is completed; and withholding firing of selected printhead nozzles as required by the image.

12. The method of claim 11 in which each of the color dots deposited over each other are overlaid on one another.

13. The method of claim 11 in which each of the color dots deposited over each other is offset from its predecessor.

14. The method of claim 11 in which the native resolution of each printhead is the space between the printhead nozzles and the native resolution is increased in the axial direction by firing each nozzle of each printhead twice in succession.

15. The method of claim 11 in which the rotating of the cylindrical printing area about its longitudinal axis is slowed to ensure that the second fired dots are properly deposited.

16. The method of claim 11 in which alternating adjacent nozzles are fired to print in alternating image columns.

17. The method of claim 11 in which the native resolution of each printhead is the space between the printhead nozzles in the nozzle columns and the image resolution is increased by firing each nozzle of each printhead column twice in succession such that a second dot is deposited at a location between the nozzle spacing defining the native resolution.

18. The method of claim 11 in which each nozzle of each printhead column is fired a plurality of times in succession such that successive dots are deposited at locations between the nozzle spacing.

* * * * *